US012672695B2

(12) United States Patent
Bartys et al.

(10) Patent No.: US 12,672,695 B2
(45) Date of Patent: Jul. 7, 2026

(54) MOVEABLE SENSORY ELEMENTS IN FOOTWEAR SOLES

(71) Applicant: NIKE, Inc., Beaverton, OR (US)

(72) Inventors: Samuel Bartys, London (GB); Rikke Bonde, Portland, OR (US); Marcos Bonfiglioli, Portland, OR (US); Bilan DeDonato, Portland, OR (US); Sarah Linville, Portland, OR (US); Sean Lu, Beaverton, OR (US); Shamees Mohamed, Portland, OR (US); Will Moroski, Portland, OR (US); Andrew Nakajima, Brooklyn, NY (US); Daniel Song, Portland, OR (US); Sara Sutton, Portland, OR (US); Chance Tagg, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/817,611

(22) Filed: Aug. 28, 2024

(65) Prior Publication Data

US 2025/0082063 A1 Mar. 13, 2025

Related U.S. Application Data

(60) Provisional application No. 63/582,316, filed on Sep. 13, 2023.

(51) Int. Cl.
*A43B 13/22* (2006.01)
*A43B 7/1455* (2022.01)
(Continued)

(52) U.S. Cl.
CPC ..... *A43B 7/146* (2013.01); *A43B 13/226* (2013.01); *A43B 13/26* (2013.01); *A43C 15/14* (2013.01)

(58) Field of Classification Search
CPC ..... A43C 15/08; A43C 15/14; A43B 13/122; A43B 13/125; A43B 13/126; A43B 7/146; A43B 7/148
See application file for complete search history.

(56) References Cited

U.S. PATENT DOCUMENTS

D15,185 S 8/1884 Brooks
429,429 A 6/1890 Eckhardt
(Continued)

FOREIGN PATENT DOCUMENTS

CA 2052070 1/1993
CN 101188955 5/2008
(Continued)

OTHER PUBLICATIONS

International Search Report and Written Opinion dated Nov. 26, 2024, from International Patent Application No. PCT/US2024/044137, 18 pp.
(Continued)

*Primary Examiner* — Ted Kavanaugh
(74) *Attorney, Agent, or Firm* — Klarquist Sparkman, LLP

(57) ABSTRACT

A sole system for an article of footwear can include a sole member and a protruding member assembly. The sole member includes outwardly and inwardly facing surfaces, a plurality of spaced apart first apertures extending though the sole member, and a plurality of first protruding members extending outward from and fixed to a base surface of the outwardly facing surface. The protruding member assembly includes a plurality of second protruding members that are interconnected by connecting portions, where the connecting portions are received on the inwardly facing surface of
(Continued)

the sole member, and where each second protruding member is vertically movable within a corresponding first aperture of the sole member.

20 Claims, 11 Drawing Sheets

(51) Int. Cl.
*A43B 13/26* (2006.01)
*A43C 15/14* (2006.01)

(56) References Cited

U.S. PATENT DOCUMENTS 2,061,962 A 11/1936 Carlo
2,327,360 A 8/1943 Meyer
2,330,317 A 9/1943 Stewart
2,853,809 A 9/1958 Bianchi
3,191,321 A 6/1965 Brutting
3,204,347 A 9/1965 Snow
3,328,901 A 7/1967 Strickland
3,612,043 A 10/1971 Inaki
3,626,611 A 12/1971 Bernier et al.
3,718,996 A 3/1973 Austin
3,722,113 A 3/1973 Birkenstock
3,757,774 A 9/1973 Hatuno
3,834,046 A 9/1974 Fowler
4,060,917 A 12/1977 Canale
4,063,371 A 12/1977 Batra
4,067,123 A 1/1978 Minihane
4,085,526 A 4/1978 Hemmer
4,271,606 A 6/1981 Rudy
4,271,608 A 6/1981 Tomuro
4,715,133 A 12/1987 Hartjes et al.
4,747,220 A 5/1988 Autry et al.
4,782,604 A 11/1988 Wen-Shown
4,798,009 A 1/1989 Colonel et al.
4,811,501 A 3/1989 Okayasu
4,823,799 A 4/1989 Robbins
RE33,066 E 9/1989 Stubblefield
4,887,367 A 12/1989 Mackness et al.
4,897,936 A 2/1990 Fuerst
4,972,611 A 11/1990 Swartz et al.
5,077,916 A 1/1992 Beneteau
5,367,791 A 11/1994 Gross et al.
5,377,431 A 1/1995 Walker et al.
5,595,003 A 1/1997 Snow
5,607,749 A 3/1997 Strumor
5,768,802 A 6/1998 Bramani
5,775,005 A 7/1998 McClelland
D397,237 S 8/1998 Teague
5,862,614 A 1/1999 Koh
5,915,819 A 6/1999 Gooding
5,926,974 A 7/1999 Friton
5,946,825 A 9/1999 Koh et al.
5,987,781 A 11/1999 Pavesi et al.
6,029,377 A 2/2000 Niikura et al.
6,079,127 A 6/2000 Nishimura et al.
6,082,024 A 7/2000 Del Biondi
6,138,281 A 10/2000 Chiaruttini
6,161,315 A 12/2000 Dalton
6,275,997 B1 8/2001 Richardson
D448,919 S 10/2001 Montross et al.
D453,872 S 2/2002 White
6,481,122 B2 11/2002 Brahler
6,516,540 B2 2/2003 Seydel et al.
6,523,282 B1 2/2003 Johnston
6,691,432 B2 2/2004 Masseron
6,698,110 B1 3/2004 Robbins
6,715,221 B1 4/2004 Sasaki
6,732,457 B2 5/2004 Gardiner
6,739,075 B2 5/2004 Sizemore
6,920,707 B1 7/2005 Greene et al.
7,013,588 B2 3/2006 Chang
7,069,672 B2 7/2006 Hahn
7,089,690 B2 8/2006 Krstic
7,140,129 B2 11/2006 Newson et al.
7,264,599 B1 9/2007 Milligan
7,290,357 B2 11/2007 McDonald et al.
7,313,875 B2 1/2008 Morgan
7,346,936 B2 3/2008 Vargas et al.
D570,584 S 6/2008 Cyrille
7,430,819 B2 10/2008 Auger et al.
7,451,557 B2 11/2008 McDonald et al.
7,523,566 B2 4/2009 Young-Chul
7,549,236 B2 6/2009 Dillon et al.
7,665,229 B2 2/2010 Kilgore et al.
7,681,333 B2 3/2010 Dardinski et al.
7,752,772 B2 7/2010 Hatfield et al.
7,849,609 B2 12/2010 Edington et al.
7,882,648 B2 2/2011 Langvin
7,913,420 B2 3/2011 Arizumi
7,918,811 B2 4/2011 Lussier et al.
7,941,943 B2 5/2011 Baker et al.
7,954,257 B2 6/2011 Banik
7,966,748 B2 6/2011 Votolato
8,006,411 B2 8/2011 Manz et al.
8,074,376 B1 12/2011 Teteriatnikov
8,079,160 B2 * 12/2011 Baucom ..... A43C 15/14 36/61
D652,614 S 1/2012 Raysse
8,162,860 B1 4/2012 Ali
8,215,032 B2 7/2012 Sokolowski et al.
8,256,145 B2 9/2012 Baucom et al.
8,333,022 B2 12/2012 Crowley, II et al.
8,341,855 B2 1/2013 Teteriatnikov
8,387,281 B2 3/2013 Loverin et al.
D684,756 S 6/2013 Dekovic
8,656,610 B2 2/2014 Baucom
8,661,712 B2 3/2014 Aveni et al.
D708,831 S 7/2014 Petrie
8,763,276 B2 7/2014 Greene et al.
8,763,277 B2 7/2014 Sartor
D719,329 S 12/2014 Smith et al.
8,914,993 B2 12/2014 Hay et al.
8,950,087 B2 2/2015 Baucom et al.
D723,773 S 3/2015 Raysse
D723,774 S 3/2015 Raysse
D723,788 S 3/2015 Raysse
8,984,771 B1 3/2015 Kramer
9,144,264 B2 * 9/2015 Marvin ..... A43B 13/14
9,161,591 B2 10/2015 Landau
9,516,917 B2 12/2016 Hoffer et al.
9,516,918 B2 12/2016 Meschter et al.
9,603,413 B2 3/2017 Kramer
10,016,014 B2 7/2018 Meschter et al.
10,034,514 B2 7/2018 Meschter et al.
10,058,145 B2 8/2018 Meschter et al.
10,172,417 B2 1/2019 Hoffer et al.
10,182,614 B2 1/2019 Meschter et al.
10,285,468 B2 * 5/2019 Van Atta ..... A43B 5/16
10,687,582 B2 6/2020 Meschter et al.
10,694,811 B2 6/2020 Meschter et al.
10,856,608 B2 12/2020 Hoffer et al.
10,856,609 B2 12/2020 Meschter et al.
10,856,612 B2 12/2020 Heard et al.
10,893,720 B2 * 1/2021 Van Atta ..... A43B 7/146
10,980,313 B2 4/2021 Meschter et al.
11,503,877 B2 11/2022 Meschter et al.
11,540,593 B2 1/2023 Meschter et al.
2001/0047597 A1 12/2001 Smith
2002/0078598 A1 6/2002 Bell
2002/0184793 A1 12/2002 Sato
2005/0188562 A1 9/2005 Clarke et al.
2005/0217148 A1 10/2005 Connolly et al.
2005/0241189 A1 11/2005 Elkington et al.
2006/0000119 A1 1/2006 Endo
2006/0048413 A1 3/2006 Sokolowski et al.
2007/0113425 A1 5/2007 Wakley et al.
2007/0180730 A1 8/2007 Greene
2007/0277401 A1 12/2007 Young-Chul
2008/0066348 A1 3/2008 O'Brien et al.
2008/0078106 A1 4/2008 Montgomery
2008/0127515 A1 6/2008 Lohrer

(56) References Cited

U.S. PATENT DOCUMENTS

| | | | | |
|---|---|---|---|---|
| 2008/0209766 | A1 | 9/2008 | Braunschweiler | |
| 2008/0250666 | A1 | 10/2008 | Votolato | |
| 2009/0038180 | A1 | 2/2009 | Jacob | |
| 2009/0044432 | A1 | 2/2009 | O'Connor et al. | |
| 2009/0056172 | A1 | 3/2009 | Cho | |
| 2009/0083993 | A1 | 4/2009 | Plank | |
| 2009/0113765 | A1 | 5/2009 | Robinson et al. | |
| 2010/0011620 | A1 | 1/2010 | Nakano | |
| 2010/0077635 | A1* | 4/2010 | Baucom | A43C 15/14 36/61 |
| 2010/0083541 | A1 | 4/2010 | Baucom et al. | |
| 2010/0175276 | A1 | 7/2010 | Dojan et al. | |
| 2010/0251565 | A1 | 10/2010 | Litchfield et al. | |
| 2011/0072684 | A1 | 3/2011 | Stubblefield | |
| 2011/0088287 | A1 | 4/2011 | Auger et al. | |
| 2011/0126422 | A1 | 6/2011 | Vattes et al. | |
| 2011/0138657 | A1 | 6/2011 | Christensen | |
| 2011/0192056 | A1* | 8/2011 | Geser | A43B 13/26 36/114 |
| 2011/0247243 | A1 | 10/2011 | Eder et al. | |
| 2011/0252671 | A1 | 10/2011 | Maron et al. | |
| 2011/0277346 | A1 | 11/2011 | Peyton et al. | |
| 2012/0023777 | A1 | 2/2012 | Greene | |
| 2012/0023786 | A1 | 2/2012 | Dojan | |
| 2012/0055047 | A1 | 3/2012 | Youngs | |
| 2012/0073160 | A1 | 3/2012 | Marvin et al. | |
| 2012/0167414 | A1 | 7/2012 | Shrairman | |
| 2012/0240432 | A1 | 9/2012 | Lambertz | |
| 2012/0291315 | A1* | 11/2012 | Baucom | A43B 1/0018 36/134 |
| 2012/0317843 | A1 | 12/2012 | Bove | |
| 2013/0031804 | A1 | 2/2013 | Abshire | |
| 2013/0152424 | A1 | 6/2013 | Dojan | |
| 2013/0212909 | A1 | 8/2013 | Bates et al. | |
| 2014/0013617 | A1 | 1/2014 | Montross et al. | |
| 2014/0075779 | A1 | 3/2014 | Bruce et al. | |
| 2014/0310995 | A1 | 10/2014 | Campari | |
| 2014/0325871 | A1 | 11/2014 | Price et al. | |
| 2015/0068063 | A1 | 3/2015 | Farris | |
| 2015/0128455 | A1 | 5/2015 | Lubart | |
| 2015/0143714 | A1 | 5/2015 | Tzeng | |
| 2015/0157089 | A1 | 6/2015 | Schumacher et al. | |
| 2015/0196082 | A1 | 7/2015 | Van Atta | |
| 2015/0196087 | A1 | 7/2015 | Meschter et al. | |
| 2015/0208753 | A1 | 7/2015 | Bhupesh et al. | |
| 2015/0272271 | A1 | 10/2015 | Campos, II et al. | |
| 2015/0282561 | A1 | 10/2015 | Swager Van Dok | |
| 2015/0313310 | A1 | 11/2015 | Okamoto et al. | |
| 2015/0366281 | A1 | 12/2015 | Miller et al. | |
| 2016/0095389 | A1 | 4/2016 | Minami et al. | |
| 2016/0192739 | A1* | 7/2016 | Hoffer | A43B 13/188 36/28 |
| 2016/0206043 | A1 | 7/2016 | Cohen | |
| 2016/0302522 | A1 | 10/2016 | Meschter | |
| 2016/0302523 | A1 | 10/2016 | Fujita et al. | |
| 2016/0360829 | A1 | 12/2016 | Meschter et al. | |
| 2017/0006963 | A1 | 1/2017 | Hoffer et al. | |
| 2018/0098601 | A1 | 4/2018 | Hartenstein et al. | |
| 2018/0228251 | A1 | 8/2018 | Sussmann | |
| 2019/0053567 | A1 | 2/2019 | Thomas | |
| 2020/0315292 | A1* | 10/2020 | Meschter | A43B 13/16 |
| 2020/0315992 | A1 | 10/2020 | Meschter et al. | |

FOREIGN PATENT DOCUMENTS

| | | |
|---|---|---|
| CN | 201595237 | 10/2010 |
| CN | 102164518 | 8/2011 |
| CN | 102715708 | 10/2012 |
| CN | 104640467 | 5/2015 |
| CN | 102415643 | 4/2023 |
| DE | 8304272 | 10/1983 |
| DE | 3520956 | 1/1987 |
| DE | 202006016038 | 1/2007 |
| DE | 202010017958 | 6/2013 |
| EP | 0334781 | 9/1989 |
| EP | 1369048 | 12/2003 |
| EP | 1557105 | 7/2005 |
| EP | 2494879 | 9/2012 |
| EP | 2594146 | 5/2013 |
| JP | H05-115308 | 5/1993 |
| JP | 3082440 | 12/2001 |
| KR | 10-0870929 | 11/2008 |
| SU | 971240 | 11/1982 |
| WO | WO 93/05674 | 4/1993 |
| WO | WO 97/36508 | 10/1997 |
| WO | WO 2004/014171 | 2/2004 |
| WO | WO 2006/127427 | 11/2006 |
| WO | WO 2007/087581 | 8/2007 |
| WO | WO 2009/017358 | 2/2009 |
| WO | WO 2009/131356 | 10/2009 |
| WO | WO 2010/137068 | 12/2010 |
| WO | WO 2014/046915 | 3/2014 |
| WO | WO 2015/108593 | 7/2015 |
| WO | WO 2015/108594 | 7/2015 |
| WO | WO 2016/085553 | 6/2016 |

OTHER PUBLICATIONS

International Preliminary Report on Patentability dated Jul. 28, 2016, from PCT Application No. PCT/US2014/062104, 11 pp.
International Search Report and Written Opinion dated Jan. 29, 2015, from PCT Application No. PCT/US2014/062104, 15 pp.
International Search Report and Written Opinion dated Oct. 21, 2015, from PCT Application No. PCT/US2015/042822, 15 pp.
International Search Report and Written Opinion dated Nov. 30, 2015, from PCT Application No. PCT/US2015/047956, 14 pp.
International Search Report and Written Opinion dated May 17, 2017, for PCT Application No. PCT/US2017/019177, 10 pp.
International Search Report and Written Opinion dated May 22, 2017, for PCT Application No. PCT/US2017/019176, 13 pp.
International Search Report and Written Opinion dated May 24, 2017, for PCT Application No. PCT/US2017/019171, 15 pp.
International Search Report and Written Opinion dated May 24, 2017, for PCT Application No. PCT/US2017/019173, 14 pp.
International Search Report and Written Opinion dated Jun. 1, 2017, for PCT Application No. PCT/US2017/019167, 16 pp.
Office Action dated May 2, 2017, from Chinese Patent Application No. 201480077128.6, 8 pp. No English translation provided.
Office Action dated Nov. 28, 2017, from Taiwanese Patent Application No. 106106963, 23 pp.
Office Action dated Dec. 20, 2017, from Taiwanese Patent Application No. 106107103, 13 pp.
Office Action dated Dec. 20, 2017, from Taiwanese Patent Application No. 106106965, 24 pp.
Response to Rules 161 and 162 EPC Communication filed Mar. 13, 2017, from European Patent Application No. 14806112.0, 9 pp.
Screenshot of website https://www.youtube.com/watch?v=0Njve1rhPG8 titled "Skechers GOwalk 3 Commercial," which is identified as "Published on Jan. 19, 2015."

* cited by examiner

MOVEABLE SENSORY ELEMENTS IN FOOTWEAR SOLES

CROSS-REFERENCE TO RELATED APPLICATIONS

This application claims the benefit of U.S. Provisional Patent Application No. 63/582,316, filed Sep. 13, 2023, which is incorporated by reference herein in its entirety.

FIELD

This disclosure relates generally to articles of footwear and, in particular to a sole system for articles of footwear.

BACKGROUND

An article of footwear typically includes two main components: a sole structure and an upper. The sole structure is configured for supporting the wearer's foot and providing cushioning between the wearer's foot and the ground. The sole structure may include an outsole that is adapted to contact the ground. The upper is coupled to the sole structure and is configured for securing the wearer's foot to the sole structure.

DETAILED DESCRIPTION

General Considerations

Figure 1:
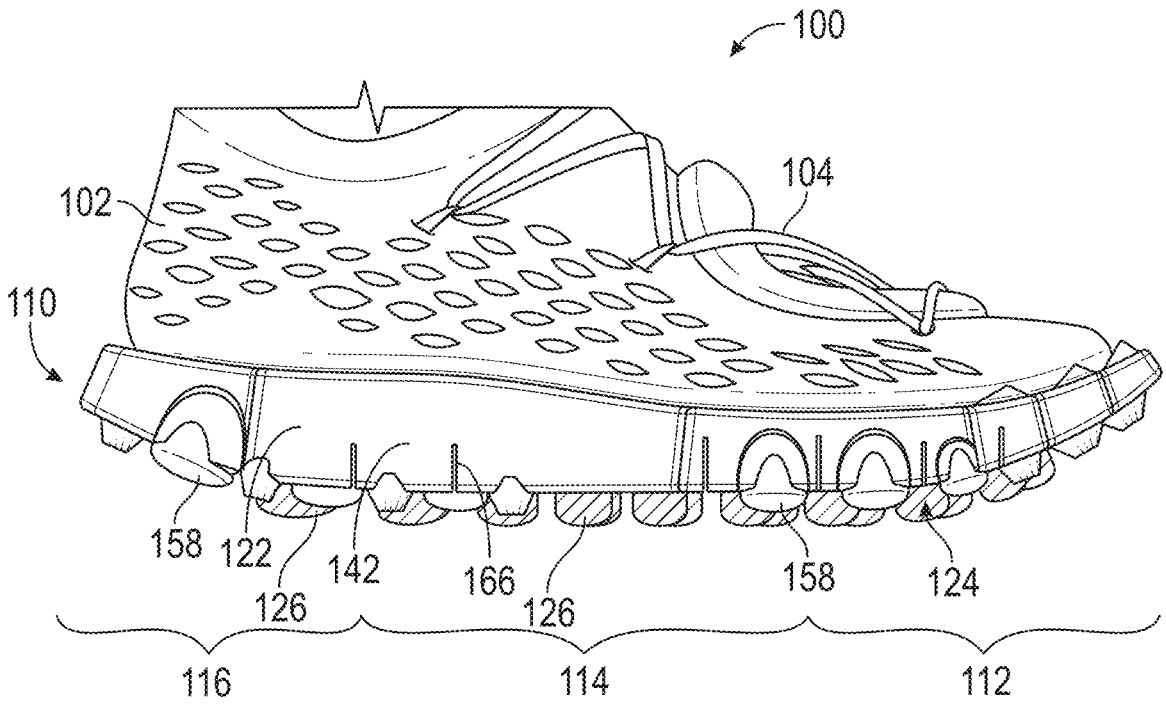
FIG. 1 is a lateral side view of an exemplary article of footwear which includes a sole system.

The systems and methods described herein, and individual components thereof, should not be construed as being limited to the particular uses or systems described herein in any way. Instead, this disclosure is directed toward all novel and non-obvious features and aspects of the various disclosed examples, alone and in various combinations and subcombinations with one another. For example, any features or aspects of the disclosed examples can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

For purposes of this disclosure, portions of an article of footwear (and the various component parts thereof) may be identified based on regions of the foot located at or near that portion of the article of footwear when the footwear is worn on the properly sized foot. For example, an article of footwear and/or a sole structure may be considered as having a "forefoot region" at the front of the foot, a "midfoot" region at the middle or arch area of the foot, and a "heel region" at the rear of the foot. Footwear and/or sole structures also include a "lateral side" (the "outside" or "little toe side" of the foot) and a "medial side" (the "inside" or "big toe side" of the foot). The forefoot region generally includes portions of the footwear corresponding to the toes and the joints connecting the metatarsals with the phalanges. The midfoot region generally includes portions of the footwear corresponding with the arch area of the foot. The heel region generally corresponds with the rear portions of the foot, including the calcaneus bone. The lateral and medial sides of the footwear extend through the forefoot, midfoot, and heel regions and generally correspond with opposite sides of the footwear (and may be considered as being separated by a central longitudinal axis). These regions and sides are not intended to demarcate precise areas of footwear. Rather, the terms "forefoot region," "midfoot region," "heel region," "lateral side," and "medial side" are intended to represent general areas of an article of footwear and the various components thereof to aid the in discussion that follows.

For purposes of this disclosure, directional adjectives may be employed which correspond to the illustrated example. For example, the term "longitudinal" as used herein refers to a direction extending a length of an article. In some cases, the longitudinal direction may extend from a forefoot portion to a heel portion of the article. Also, the term "lateral" as used herein refers to a direction extending a width of an article. In other words, the lateral direction may extend between a medial side and a lateral side of an article. Furthermore, the term "vertical" as used herein refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

As used herein, the term "exemplary" means serving as a non-limiting example, instance, or illustration. As used herein, the terms "e.g.," and "for example," introduce a list of one or more non-limiting examples, instances, and/or illustrations.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "articles of footwear" or "articles" mean any type of footwear, including, for example, basketball shoes, volleyball shoes, tennis shoes, running shoes, soccer shoes, football shoes, rugby shoes, baseball shoes, sneakers, hiking boots, sandals, socks, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

An article of footwear typically includes two main components: a sole structure and an upper. The sole structure is configured for supporting the wearer's foot and providing cushioning between the wearer's foot and the ground (e.g., the surface on which they are moving, walking, running, etc.). The upper is coupled to the sole structure and forms a foot-receiving cavity. The upper is configured for securing the wearer's foot to the sole structure and/or can protect the wearer's foot.

While articles of footwear can be designed to provide support and increased performance for the wearer for certain activities (e.g., running, walking, playing court sports, and the like), they may not provide overall increased wellness. It may be beneficial for articles of footwear to provide feedback to a wearer (e.g., tactile feedback) and/or enhance a wearer's overall health.

Disclosed herein are articles of footwear that comprise a sole system (which may be referred to as a multi-part sole structure) which provides tactile feedback or enhanced tactile sensation to the sole of the foot of the person wearing the article of footwear ("the wearer"). For example, the sole system can include features that provide a tactile response to the wearer's sole, as the wearer moves along a ground surface, and in response to variations in the ground surface. In some examples, the sole system can be configured to improve balance and positional awareness or proprioception of the wearer through stimulation of the wearer's foot by the sole system.

More specifically, described herein are sole systems that can include a sole member and a protruding member assembly that is configured to be received within the sole member. The sole member can form a ground-facing surface of the article of footwear, and the protruding member assembly can comprise a plurality of protruding members that are interconnected by connecting portions. The protruding members can extend through and out of apertures in the sole member, such that the protruding members can interact with a ground surface on which the wearer is walking, running, or the like. The connecting portions can be supported on an inward facing surface of the sole member such that the protruding member assembly is supported by and within the sole member, but the protruding members are able to move vertically (up and down within the apertures of the sole member) relative to a remainder of the sole system (and relative to one another). As a wearer moves across the ground surface, the protruding members that hit the ground surface can be pushed inward through the sole system and against the wearer's foot, thereby applying pressure to (and stimulating) the wearer's foot.

The stimulation of the wearer's foot at certain points along their foot by the protruding members provides the wearer with tactile feedback that can increase their positional awareness or proprioception. Further, in some instances, by wearing the article of footwear with such a sole system for a period of time (e.g., days, weeks, months, or the like), a wearer can improve their balance, increase blood circulation, and/or lower blood pressure. For example, stimulation of a wearer's arch can increase circulation.

In some examples, the sole systems described herein can further include an inner member positioned against the inward facing surface of the sole member and including apertures configured to receive the protruding members therethrough. The inner member and sole member can sandwich the connecting portions therebetween, thereby preventing the protruding members from falling out of the sole member as they move.

Further, in some examples, the sole member can comprise a plurality of non-active protruding members extending outward from a base, ground-facing surface of the sole member. The non-active protruding members can be stationary relative to a remainder of the sole system and not configured to move vertically toward the wearer's foot. Such non-active protruding members on the sole member can act as support points or stopping points for the active protruding members of the protruding member assembly (thereby limiting their upward or inward movement against the wearer's foot).

An arrangement of the protruding members of the protruding member assembly across the sole system, as well as a shape, size, and/or spacing of the protruding members, can be specified based on the wearer (e.g., the foot size, height, weight, and/or gender of the wearer), and/or a desired tactile experience or wellness benefit. For example, positioning the protruding members in certain regions of the sole system (e.g., the forefoot, heel, arch region, or the like), can help improve balance, reduce blood pressure, increase circulation, or the like, in the wearer, and these regions may be different for different people (e.g., male vs. female, tall vs. short, or the like).

In some examples, a sole system for an article of footwear can comprise a sole member comprising an outwardly facing surface, an inwardly facing surface, and a plurality of spaced apart first apertures extending though the sole member, between the inwardly facing surface and the outwardly facing surface. The sole member comprises a plurality of first protruding members extending outward from a base surface of the outwardly facing surface, and each first protruding member is fixed to the base surface. The sole system can further comprise a protruding member assembly comprising a plurality of second protruding members that are interconnected by connecting portions. The connecting portions are received on the inwardly facing surface of the sole member, and each second protruding member is vertically movable within a corresponding first aperture of the plurality of spaced apart first apertures of the sole member.

In some examples, a sole system for an article of footwear can comprise a sole member comprising an outwardly facing surface configured to interface with a ground surface, an inwardly facing surface, and a plurality of spaced apart first apertures extending though the sole member, between the inwardly facing surface and the outwardly facing surface. The sole system can further comprise an inner member comprising a plurality of spaced apart second apertures extending through the inner member, where the inner member is disposed against the inwardly facing surface of the sole member such that each second aperture is aligned with a corresponding first aperture of the sole member. The sole system can further comprise a protruding member assembly comprising a plurality of protruding members that are interconnected by a plurality of connecting portions, where each connecting portion is sandwiched between the inwardly facing surface of the sole member and the inner member. Each protruding member is vertically movable within a corresponding first aperture and second aperture.

In some examples, an article of footwear can comprise a sole system comprising a sole member, the sole member comprising an outwardly facing surface, an inwardly facing surface, and a plurality of spaced apart first apertures extending though the sole member, between the inwardly facing surface and the outwardly facing surface. The outwardly facing surface comprises a base surface and a network of interconnected slits that extend into the sole member from the base surface, toward the inwardly facing surface. The article of footwear can further comprise a protruding member assembly comprising a plurality of first protruding members that are interconnected by a plurality of connecting portions, where each connecting portion is received on the inwardly facing surface of the sole member. Each first protruding member is vertically movable within a corresponding first aperture of the plurality of spaced apart first apertures of the sole member, and the network of interconnected slits are formed around and between adjacent first protruding members of the plurality of first protruding members.

Additional examples of the disclosed technology are described below with reference to the accompanying drawings.

Examples of the Disclosed Technology

Figure 2:
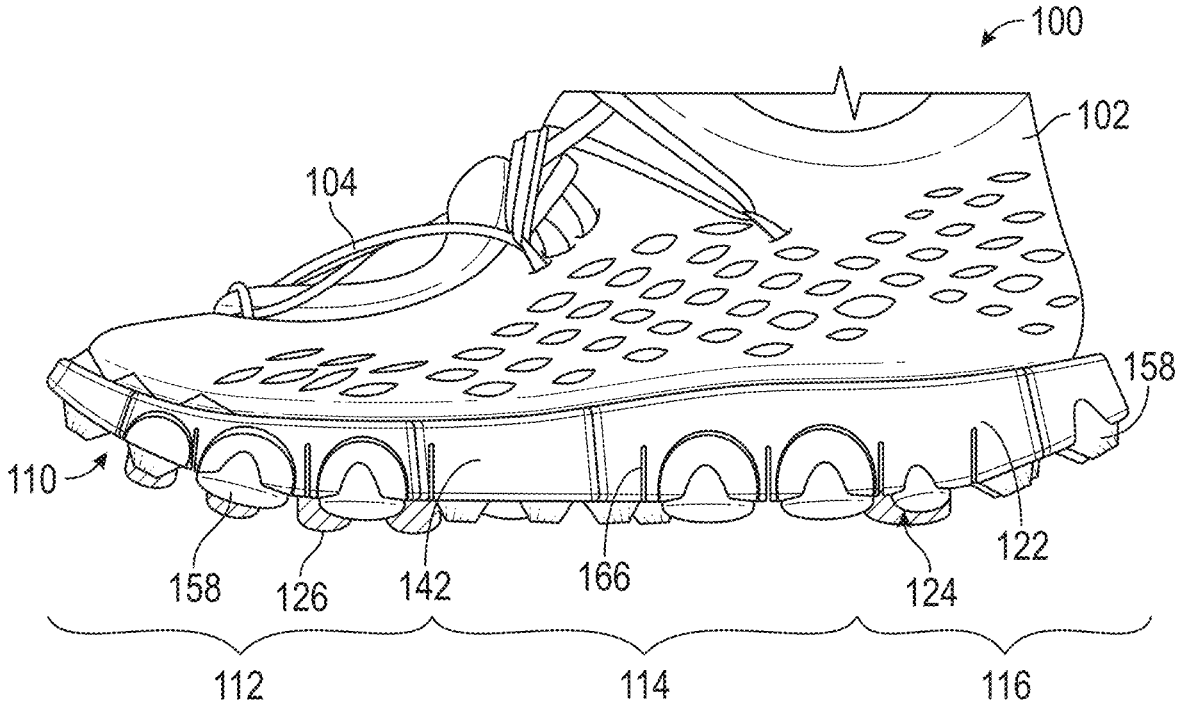
FIG. 2 is a medial side view of the article of footwear of FIG. 1.
Figure 3:
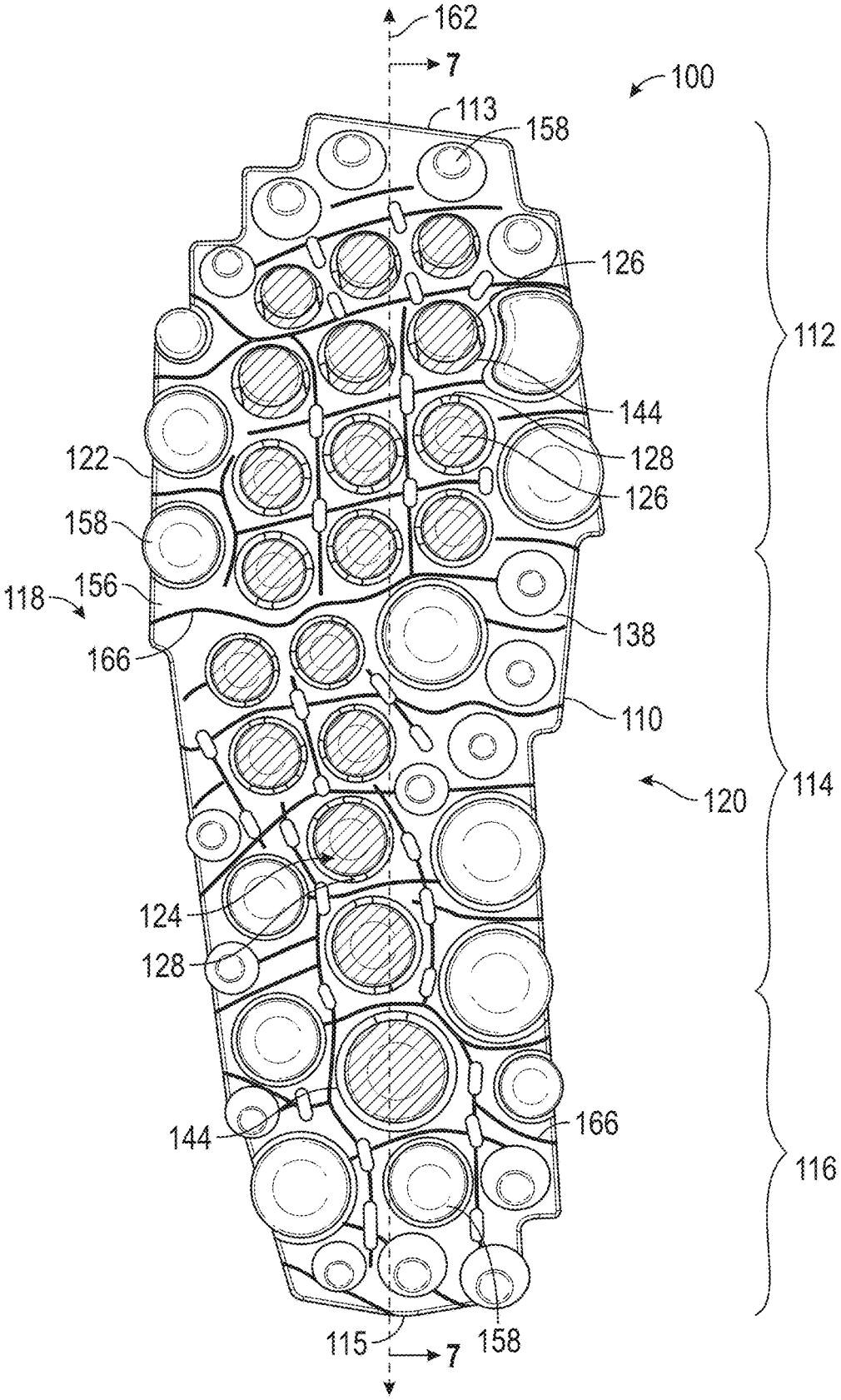
FIG. 3 is a bottom view of the article of footwear of FIG. 1.
Figure 4:
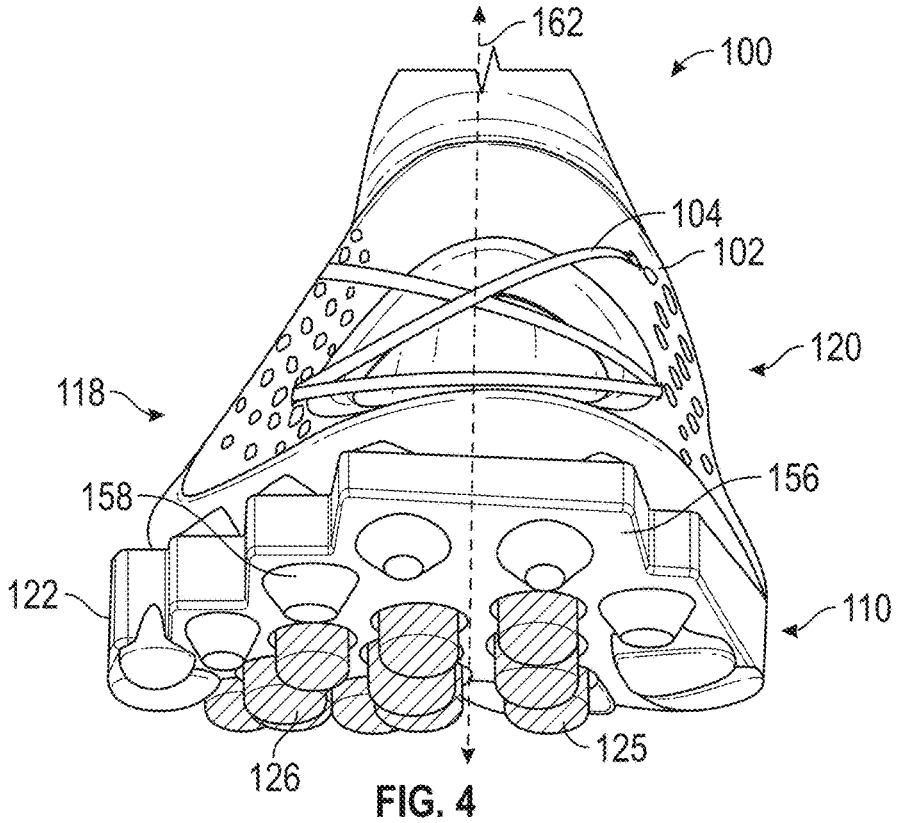
FIG. 4 is a front view of the article of footwear of FIG. 1.
Figure 5:
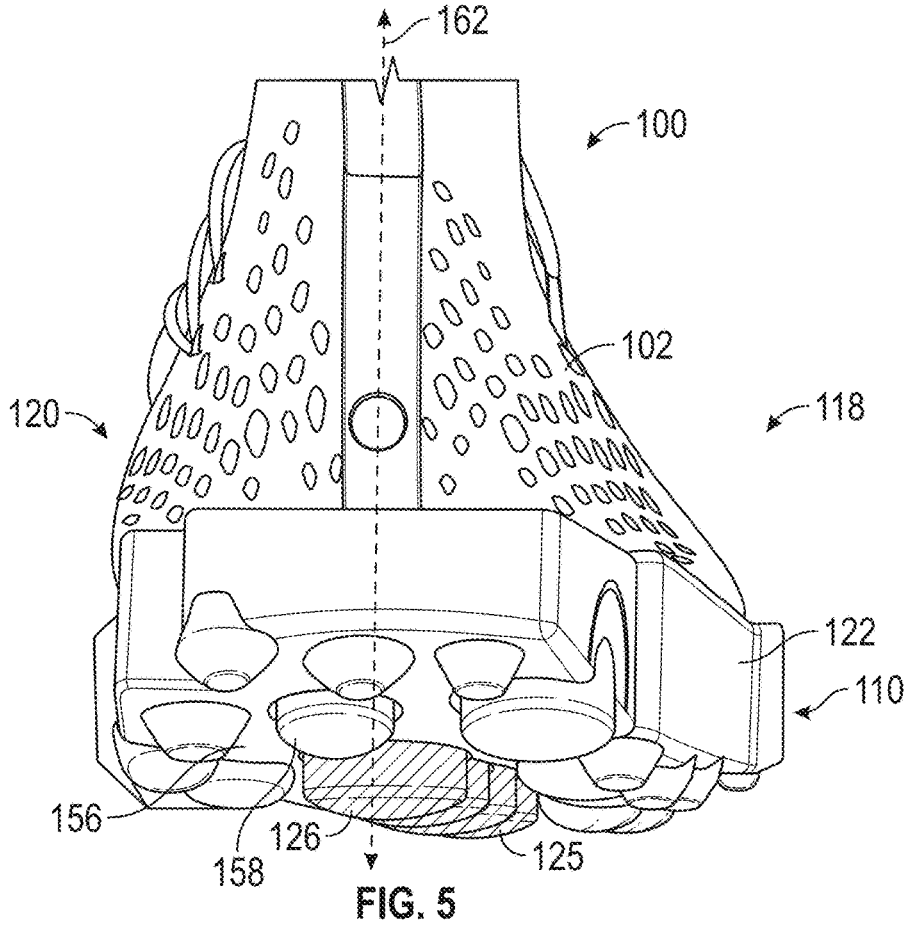
FIG. 5 is a back view of the article of footwear of FIG. 1.
Figure 6:
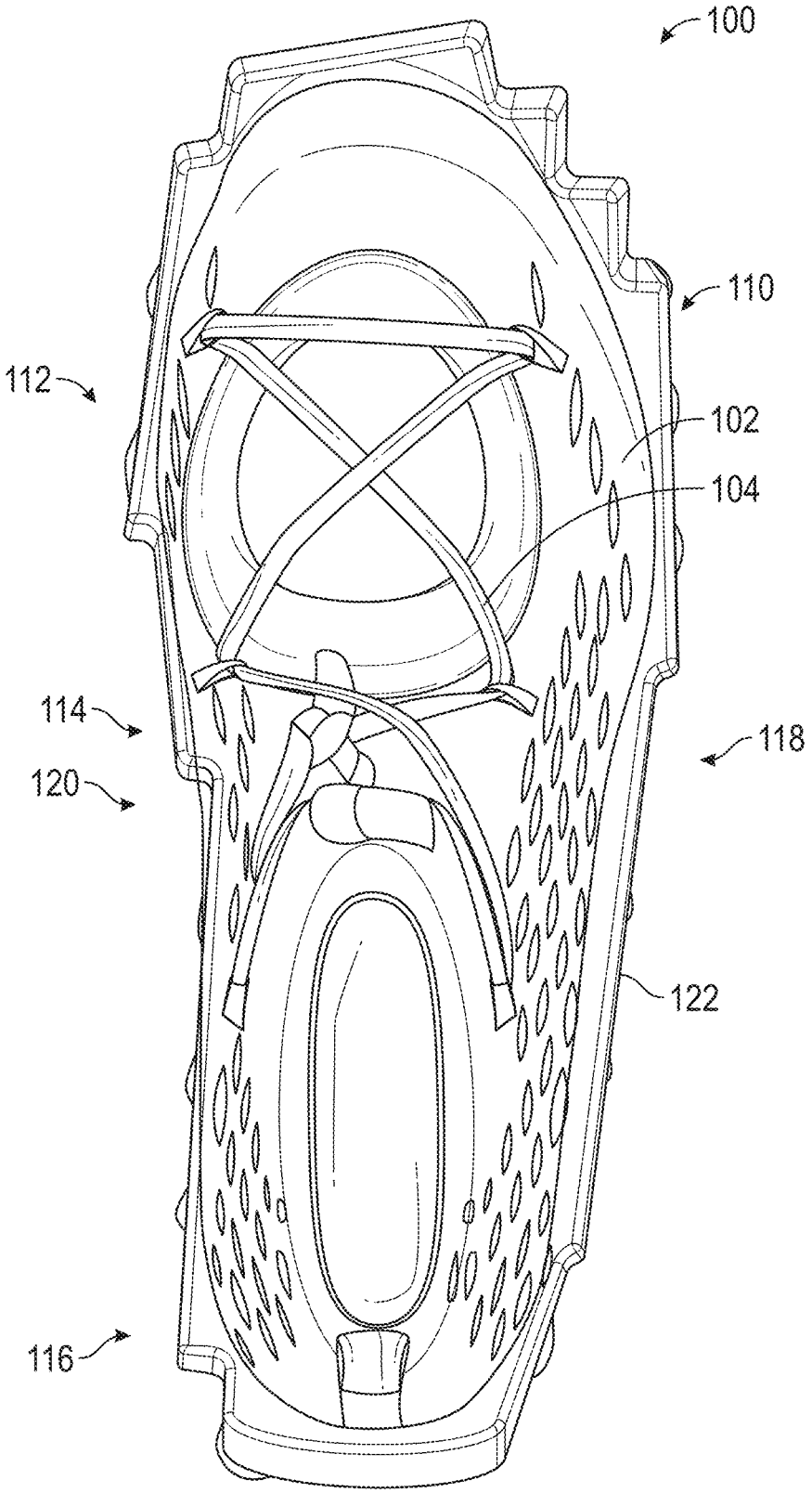
FIG. 6 is a top view of the article of footwear of FIG. 1.
Figure 7:
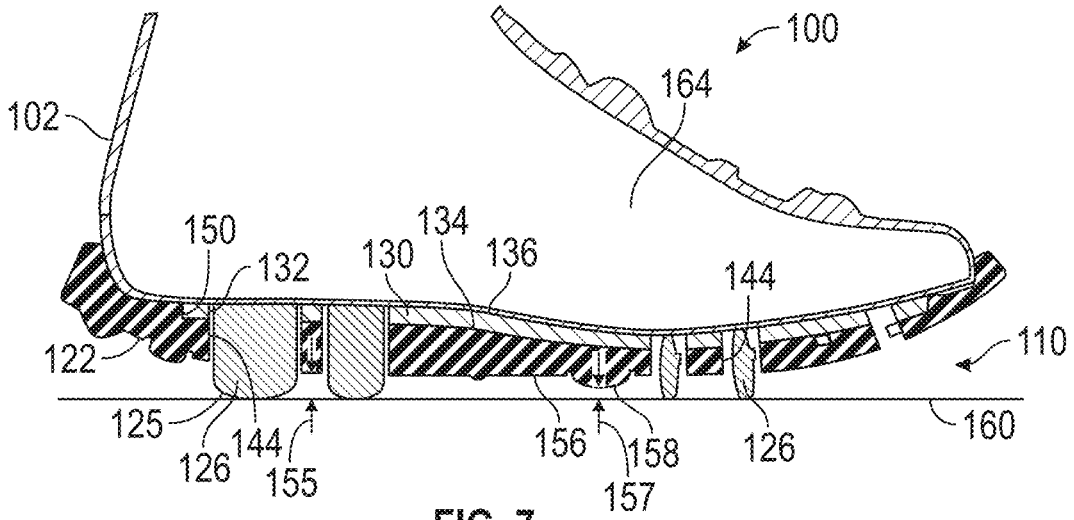
FIG. 7 is a cross-sectional side view of the article of footwear of FIG. 1.
Figure 8A:
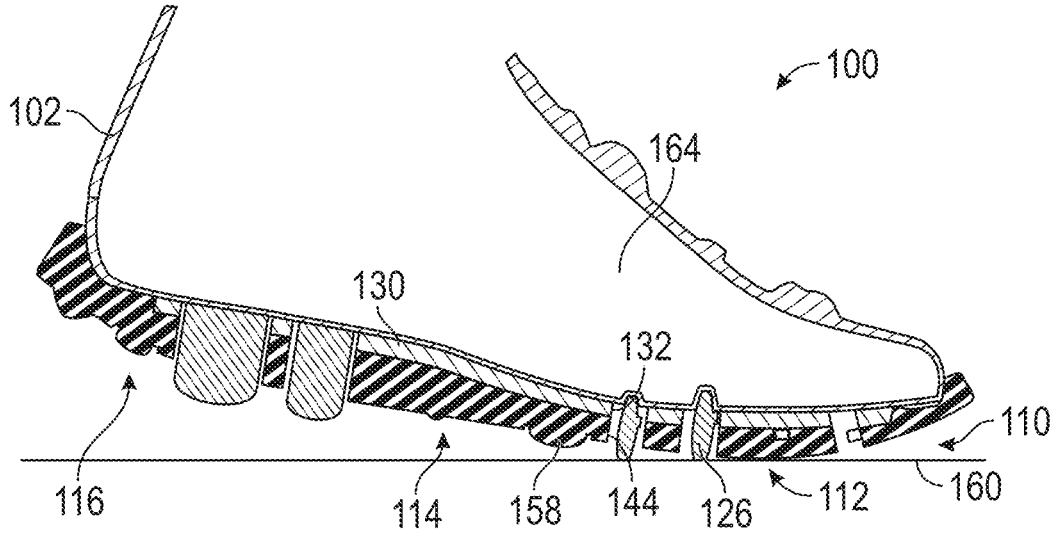
FIG. 8A is another cross-sectional side view of the article of footwear of FIG. 1 which shows a forefoot portion of the sole system of the article engaging a ground surface.
Figure 8B:
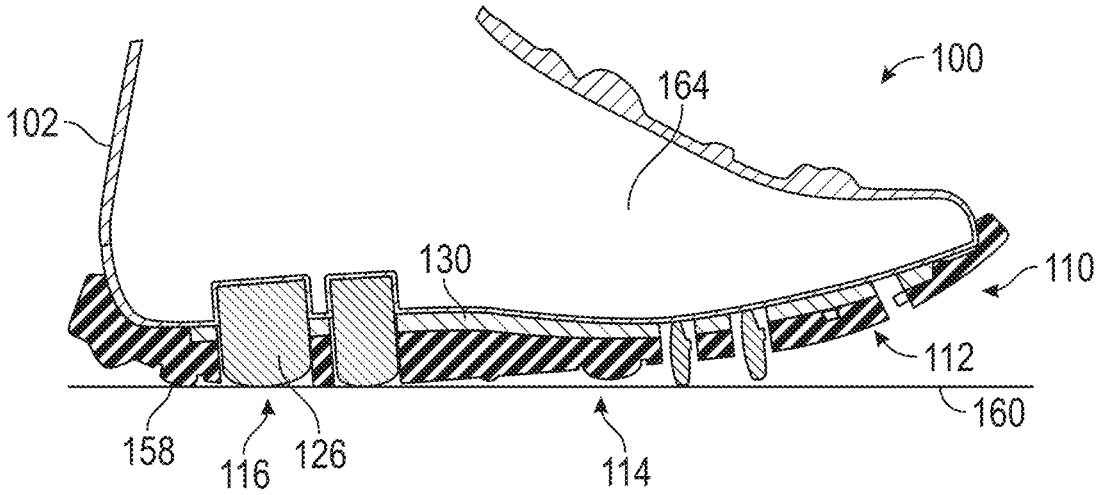
FIG. 8B is another cross-sectional side view of the article of footwear of FIG. 1 which shows a heel portion of the sole system of the article engaging the ground surface.

FIGS. 1-8B show an article of footwear 100, which can also be referred to simply as the article 100. FIG. 1 is a lateral side view of the article 100, FIG. 2 is a medial side view of the article 100, FIG. 3 is a bottom view of the article 100, FIG. 4 is a front view of the article 100, FIG. 5 is a back view of the article 100, FIG. 6 is a top view of the article 100, and FIGS. 7, 8A, and 8B are cross-sectional side views of the article 100 in various orientations.

The article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some examples the article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

In some examples, the article 100 may include an upper 102 and a sole system 110. Generally, the upper 102 may be any type of upper. In particular, the upper 102 may have any design, shape, size and/or color. For example, in examples where the article 100 is a basketball shoe, the upper 102 could be a high top upper that is shaped to provide high support on an ankle. In examples where the article 100 is a running shoe, the upper 102 could be a low top upper.

In some examples, as shown in FIGS. 1, 2 4, and 6, the upper 102 includes provisions for fastening the article 100 to a foot, such as a lacing region 104.

The sole system 110 is secured to the upper 102 and extends between the foot and the ground when the article 100 is worn by an individual. In different examples, the sole system 110 can include different components. For example, the sole system 110 can include an outsole, a midsole, and/or an insole. In some cases, one or more of these components may be optional.

The sole system 110 (which can also be referred to herein as a "sole structure") may provide one or more functions for the article 100. For example, in some examples, the sole system 110 may be configured to provide traction for the article 100. In addition to providing traction, the sole system 110 may attenuate ground reaction forces when compressed between the foot and the ground during walking, running or other ambulatory activities. The configuration of the sole system 110 may vary significantly in different examples to include a variety of conventional or non-conventional structures. In some cases, the configuration of the sole system 110 can be selected according to one or more types of ground surfaces on which the sole system 110 may be used. Examples of ground surfaces include, but are not limited to: natural turf, synthetic turf, dirt, cement, as well as other surfaces.

As described in further detail below, in some examples, the sole system 110 may also include provisions to enhance tactile sensation at the sole of the foot. For example, the sole system 110 can include features that provide a tactile response to variations in a ground surface and/or as different parts of the sole system engage the ground surface.

Referring to FIGS. 1-6, for purposes of reference, the sole system 110 can be divided into a forefoot portion 112, a midfoot portion 114 and a heel portion 116. In addition, the sole system 110 may include a lateral side 118 (the side shown in FIG. 1 and labeled in FIGS. 3-6) and a medial side 120 (the side shown in FIG. 2 and labeled in FIGS. 3-6). In particular, the lateral side 118 and the medial side 120 may be opposing sides of article 100. Furthermore, both the lateral side 118 and the medial side 120 may extend through the forefoot portion 112, midfoot portion 114, and heel portion 116.

As shown in FIGS. 3-12, the sole system 110 can include a sole member 122, which can also be referred to as a carrier, and a protruding member assembly 124. The protruding member assembly 124 comprises a plurality of protruding members 126 (or protruding portions) and a plurality of connecting portions 128 (or bridges) that interconnect the protruding members 126 (as shown in FIGS. 3, 9, 11, and 12). The sole member 122 is adapted to receive the protruding member assembly 124, as described in further detail below.

In FIGS. 1-5, the protruding members 126 of the protruding member assembly 124 are depicted with cross-hatching for the purpose of illustration only, in order to differentiate the protruding members 126 from the additional protruding members 158 of the sole member 122. As discussed further below, protruding members 126 can extend through a portion of the sole system 110 (e.g., sole member 122) to provide tactile feedback to the foot of a wearer, while additional protruding members 158 extend outward from the sole system 110 (e.g., from the sole member 122) without extending through the sole system.

As used herein, the term "protruding member" refers to any component or structure that can protrude outwardly from a surface of a sole system. In some examples, a protruding member can be a cleat member, lug, or other traction element that is configured to engage a ground surface and provide increased traction between the sole member and a ground surface. In some examples a protruding member may provide enhanced tactile sensation, as discussed in further detail below. In an example, at least some of the protruding members of a plurality of protruding members (for example, protruding members 126) can be configured as a cleat member or lug that improves traction and also facilitates enhanced tactility and sensation on the bottom of the foot.

Figure 9:
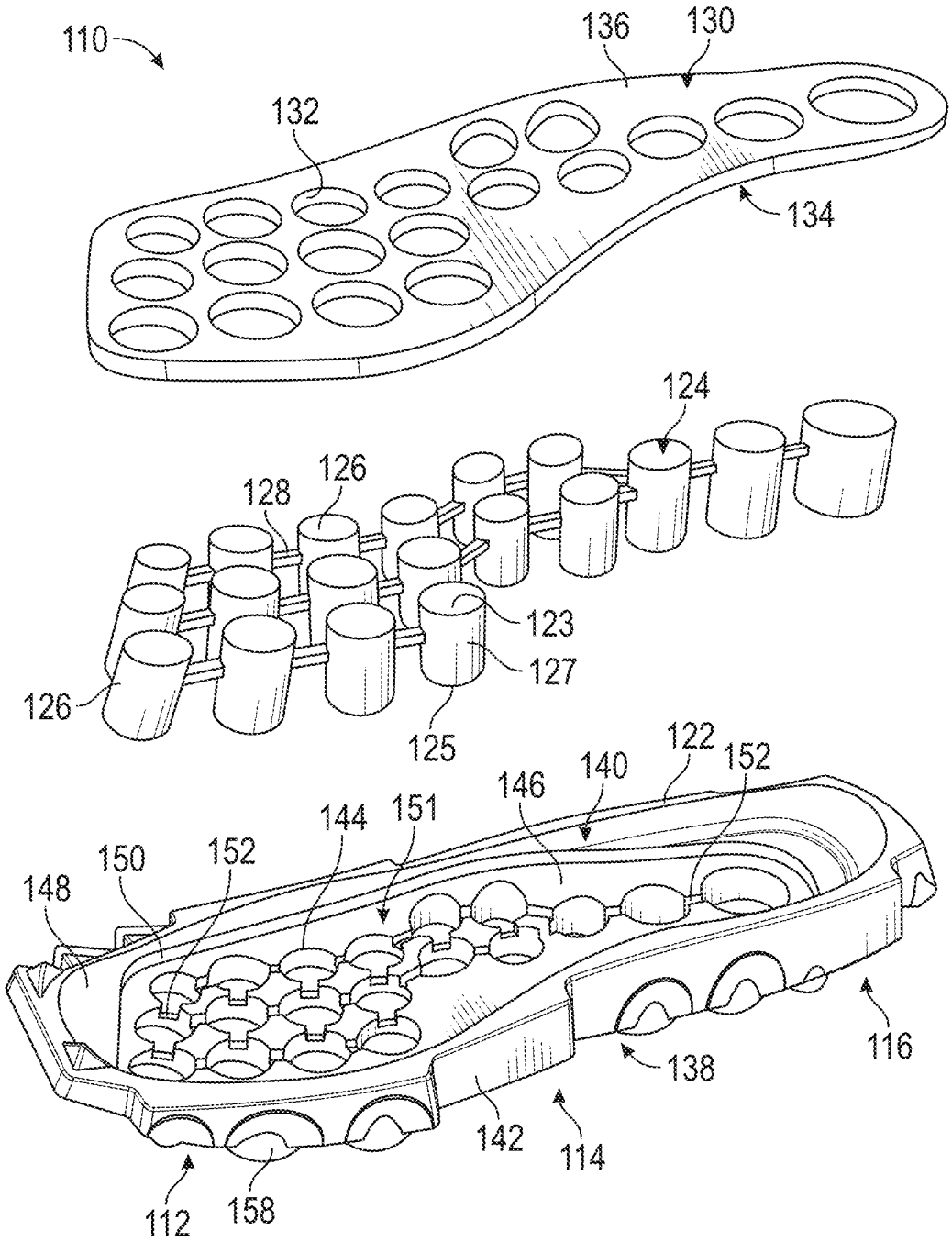
FIG. 9 is an exploded view of the sole system of the article of footwear of FIG. 1, where the sole system includes a sole member, a protruding member assembly, and an inner member that are configured to fit together.

FIGS. 1-12 illustrate various views of exemplary components of the sole system 110. In particular, FIG. 9 is an exploded view of the sole system 110 alone, which includes the sole member 122 and the protruding member assembly 124.

In some examples, as shown in FIGS. 7-9, the sole system 110 can include an inner member 130 (which can also be referred to as a cover). In some examples, the inner member 130 can comprise a plurality of spaced apart holes or apertures 132 configured to receive the protruding members 126 of the protruding member assembly 124 (such as a proximal end portion or first end portion 123 of the protruding members 126, as explained further below).

In different examples, the inner member 130 can be configured as a variety of different footwear components including, but not limited to: an insole or a sockliner. Thus, the inner member 130 can be configured to provide enhanced support for a foot as well as increased cushioning and comfort.

In some examples, the inner member 130 can be primarily associated with the sole system 110 (e.g., inner member 130 may be an insole).

In other examples, the inner member 130 may be primarily associated with the upper 102 (e.g., inner member 130 may be a part of a sockliner).

In some examples, the inner member 130 can comprise all or part of a slip last or strobel.

In some examples, the inner member 130 can be a full length member, which extends from the forefoot portion 112 to the heel portion 116 of the sole system 110.

Figure 13:
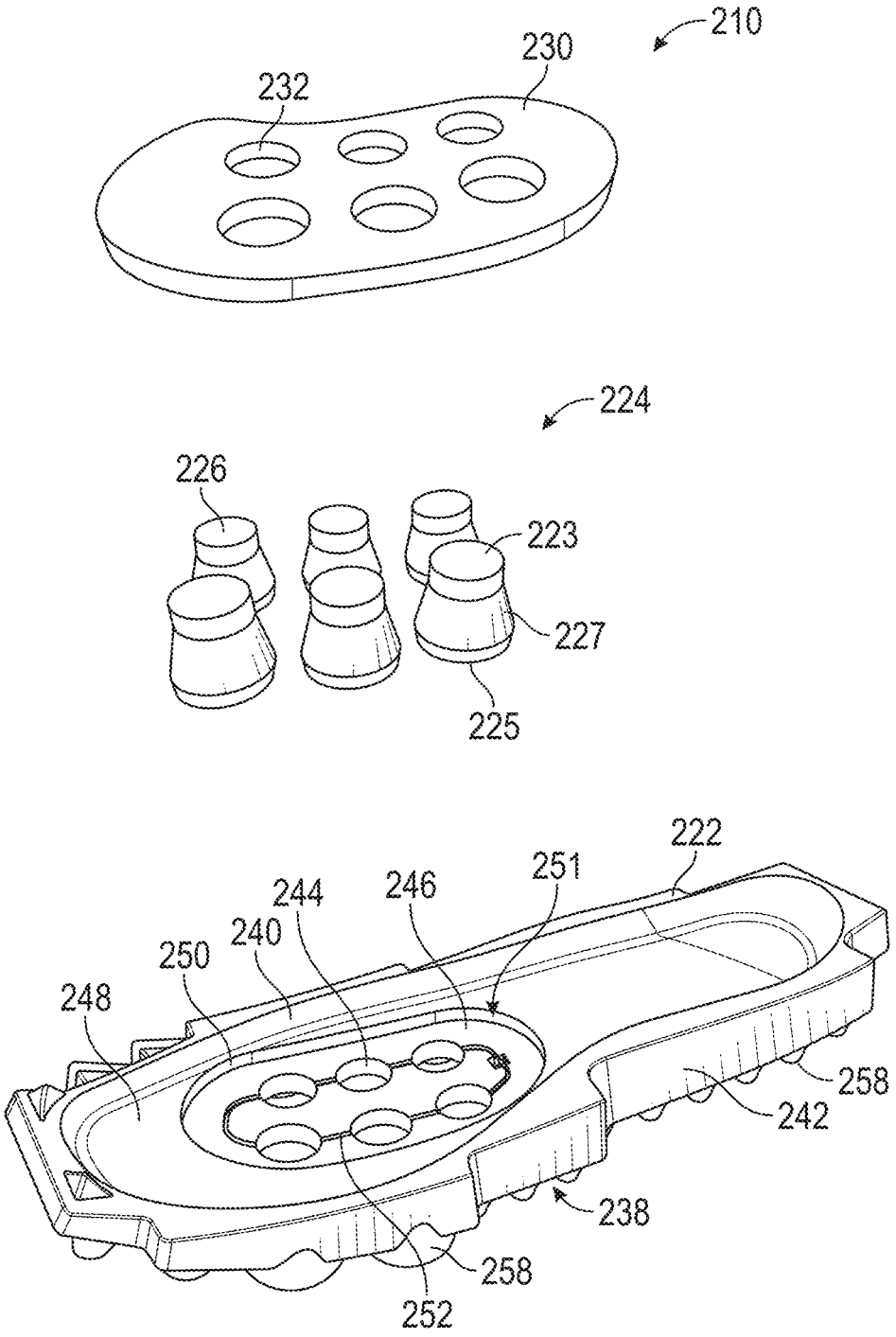
FIG. 13 is an exploded view of another exemplary sole system for an article of footwear.

In other examples, the inner member 130 can be a partial length member that extends through some portions of the sole system 110, but not others. For example, the inner member may extend through only the forefoot portion 112 or through only the heel portion 116. As another example, the inner member may extend through a portion of the forefoot portion 112 and the midfoot portion 114, but not the heel portion 116, as shown in the example of FIG. 13 (as described further below).

When used, the inner member 130 may be disposed between a wearer's foot 164 and other components of the sole system 110, including both the sole member 122 and a portion of the protruding member assembly 124 (as shown in FIGS. 7-8B). In some examples, a first surface 134 of the inner member 130 faces the sole member 122 and the protruding member assembly 124 while a second surface 136 of the inner member 130 faces towards a foot (as shown in FIGS. 7 and 9) and/or additional layers such as a strobel or other liner. In some cases, the second surface 136 may directly contact a foot during use.

The apertures 132 can extend through an entirety of the inner member 130, between the first surface 134 and the second surface 136. As a result, the apertures 132 are configured to receive a portion of the protruding members 126 of the protruding member assembly 124 therethrough, as shown in FIGS. 7-8B.

Figure 11:
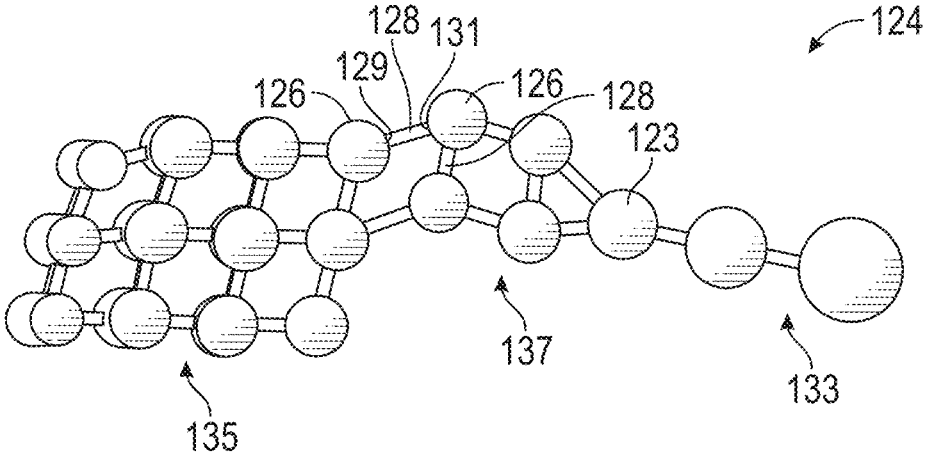
FIG. 11 is a top view of the protruding member assembly of the sole system of FIG. 9.
Figure 12:
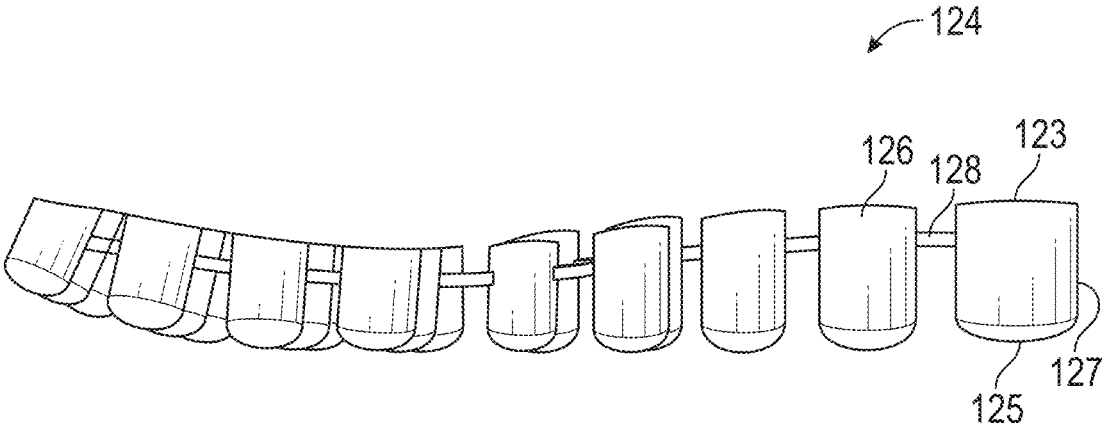
FIG. 12 is a side view of the protruding member assembly of the sole system of FIG. 9.

As shown in more detail in the exploded view of FIG. 9 and the top and side views of the protruding member assembly 124 of FIGS. 11 and 12, respectively, the protruding members 126 of the protruding member assembly 124 are spaced apart from one another and connected to one another by a plurality of connecting portions 128 (which can also be referred to as bridges, connectors, or connecting members).

Thus, each protruding member 126 can be connected to at least one other directly adjacent protruding member 126 of the protruding member assembly 124 by a connecting portion 128. In some examples, the interior protruding members 126 (which are surrounded by exterior or peripheral protruding members 126) can be connected to three or four adjacent protruding members by three or four corresponding connecting portions 128 (as shown in FIG. 11).

Each protruding member 126 can have a first end portion 123 (or proximal portion), a second end portion 125 (or distal portion) and an intermediate portion 127 that is disposed between the first end portion 123 and the second end portion 125, as indicated in FIGS. 9 and 12. In some examples, the second end portion 125 of each protruding member 126 can be configured to contact a ground surface (e.g., ground surface 160 in FIGS. 7-8B). Thus, in some instances, the second end portion 125 can function as a cleat tip or lug tip. The first end portion 123 of each protruding member 126 can be in direct contact with a wearer's foot, or in indirect contact with the wearer's foot (e.g., via a bottom portion of the upper 102, a sock liner, or an insole), thereby allowing the foot to interact with the protruding members 126 in the manner discussed below. For example, as described further below, the first end portion 123 of each protruding member 126 can be configured to interact with the wearer's foot.

In some examples, each connecting portion 128 can include a first end portion 129 and a second end portion 131. For example, FIG. 11 indicates one connecting portion 128 with its first end portion 129 connected to a first protruding member 126 and its second end portion 131 connected to an adjacent, second protruding member 126.

In some examples, the first end portion 129 and the second end portion 131 of each connecting portion 128 connect to the intermediate portion 127 of the respective first and second protruding members 126. In some examples, the first end portion 129 and the second end portion of each connecting portion 128 connect to a portion of the intermediate portions 127 of the respective first and second protruding members 126 that is disposed closer to the first end portions 123 than the second end portions 125 of the respective first and second protruding members 126 (as shown in FIGS. 9 and 12).

In alternate examples, adjacent protruding members 126 can be connected to one another via a connecting portion 128 at locations that are closer to their second end portions 125 than their first end portions 123. In some examples, it is possible that the protruding members 126 can be connected at multiple portions simultaneously (e.g., connected at both their first end portions and the intermediate portions simultaneously by one or more connecting portions 128).

In some examples, as shown in FIG. 12, the first end portion 123 of each of or one or more of the protruding members 126 can be relatively planar or have a relatively flat or level surface (which faces the wearer's foot). As a result, the first end portions 123 of the protruding members 126 can better follow or conform to a shape of the wearer's foot (or sole) and/or the footbed of the article 100.

In some examples, the second end portion 125 of each of or one or more of the protruding members 126 can be curved, rounded, or spherical (as shown in FIG. 12). In this way, the ground-facing or interacting surfaces of the protruding members 126 can be rounded or spherical. This shape of the second end portions 125 of the protruding members 126 can allow for a same pressure to be applied to the wearer's foot, when the protruding members 126 are pressed into the sole system 110 and the wearer's foot (due to interacting with the ground surface), no matter what angle the sole system 110 hits the ground (e.g., ground surface 160).

In alternate examples, the second end portion 125 of one or more protruding members 126 can be relatively flat or less rounded than shown in FIGS. 1-5, 7-9, and 12.

In some examples, the protruding members 126 can have various shapes (other than or in addition to the cylindrical and domed or spherical-tipped shapes shown in FIGS. 1-5, 7-9, 11, and 12), such as being spherical, conical, domed, cylindrical, spiked, and the like. In some examples, the protruding member assembly 124 can have protruding members 126 having a variety of shapes and sizes, such as conical protruding members, and spherical or domed-tipped cylindrical protruding members having a constant or varying diameter (e.g., a decreasing or increasing diameter) along their length. In different examples, the protruding members 126 can have a variety of geometries commonly associated with cleats, lugs, and traction elements for footwear.

In some examples, the protruding member assembly 124 can have protruding members 126 of varying size or dimension, such as protruding members 126 with different diameters, widths, heights (in the vertical direction), or the like. For example, as shown in FIGS. 3, 11, and 12, protruding member(s) 126 that are closer to (or near or within) a heel portion 116 of the sole system 110 can have a larger diameter than protruding members 126 that are closer to (or near or within) a forefoot portion 112 of the sole system 110. In some instances, larger protruding members 126 (or a single larger protruding member 126) in the heel or heel portion 116 can provide for a larger area for landing (for the heel of the wearer). The smaller diameter protruding members 126 at or closer to the forefoot portion 112 (or toe) can allow there to be a greater number of protruding members 126 within this region, thereby activating more stimulation points on a wearer's foot, as described further below.

The dimensions (e.g., diameter and/or height) of the protruding members 126 can be selected according to factors including, but not limited to, materials used, desired tactile properties, target stimulation points on a wearer's foot, user comfort, a gender of the intended wearer, a weight or weight range of the intended wearer, a height or height range of the intended wearer, and the like.

In some instances, the height (in the vertical direction) of the protruding members 126 can be smaller for an article intended to be worn by a woman, as compared to the protruding members 126 for an article intended to be worn by a man. For example, since women may have a finer sense of touch and increased tactile acuity as compared to men, they may not require as much pressure to be applied to their foot to feel the same tactile response. Thus, in some examples, the protruding members in a woman's article of footwear can have a smaller height, which can result in the protruding members pressing into the woman's foot by a smaller amount.

In some examples, the protruding member assembly 124 can have protruding members 126 having a same shape but various sizes, the same shape and size, or various shapes and sizes.

In some examples, the protruding members 126 of the protruding member assembly 124 can have a same height (in the vertical direction).

In some examples, the protruding members 126 of the protruding member assembly 124 can have different heights (in the vertical direction).

In some examples, the connecting portions 128 can have various lengths. For example, one or more connecting portions 128 of the protruding member assembly 124 can have a different length than one or more other connecting portions 128 of the protruding member assembly 124. As such, a spacing between adjacent protruding members 126 can vary, in some examples.

In some examples, the connecting portions 128 of the protruding member assembly 124 can all have the same length.

In some examples, the spacing between adjacent protruding members 126 (and thus the length of the connecting portions 128) can be made as small as possible, in order to allow for a greater number of protruding members 126 and increased sensation for a wearer, as described further below. In some examples, the spacing between adjacent protruding members 126 can be in a range of 4-11 mm, 6-10 mm, or 8-10 mm.

In different examples, the geometric pattern formed by plurality of protruding members 126 and the connecting portions 128 could vary. For example, the relative spacing between adjacent protruding members 126, the number of connecting portions 128 attached to each protruding member 126, as well as other general geometric features of the arrangement could be varied. These geometric features could be selected to achieve desired levels of tactile sensation across different regions of the foot.

In the example shown in FIGS. 1-12, the protruding member assembly 124 extends across a majority of the sole member 122, with some gaps in coverage. For example, as best seen in FIG. 11, the protruding member assembly 124 includes a heel portion 133 and a forefoot portion 135. The heel portion 133 and the forefoot portion 135 are connected by a lateral arch portion 137 and spaced apart (not connected together) on a medial side 120 of the sole member 122 (and sole system 110). This particular arrangement may be used to achieve tactile sensation in both the forefoot and heel of the wearer. Additionally, by minimizing a spacing between the protruding members 126 (within allowable manufacturing tolerances) and including as many protruding members 126 as possible (which may be limited by boundaries set by where the upper connects to the sole system 110), an increased number or stimulation points across the wearer's foot can be provided (and thus enhanced tactile feedback).

Although the current example illustrates a unitary protruding member assembly 124, other examples could comprise a protruding member assembly with disjoint sections, or multiple protruding member assemblies that are separated (and not connected by connecting portions 128), such as a separate heel protruding member assembly and forefoot protruding member assembly.

In different examples, the geometry of one or more connecting portions 128 could also vary. In the example of FIGS. 1-12, each connecting portion 128 has a strip-like or bar-like shape. In other examples, however, the geometry of each connecting portion could vary in any other manner. Other exemplary geometries could include straight geometries, curved geometries as well as regular and irregular geometries.

In some examples, the protruding member assembly 124 may be configured in a manner that allows the assembly to flex, bend, deflect, twist or otherwise undergo elastic deformation of some kind. This can be achieved through the use of connecting portions 128 that are at least partially elastic and therefore allow for some relative movement between adjacent protruding members 126.

As introduced above, the sole member 122 can be configured to receive the protruding member assembly 124. For example, as explained in more detail below, the sole member 122 can comprise a plurality of spaced apart holes or apertures 144 extending though the sole member 122 (as shown in FIGS. 3, 9 and 10), where each aperture 144 is configured to receive a respective protruding member 126 of the protruding member assembly 124 (as shown in FIGS. 3-5 and 7).

In some examples, the sole member 122 can be configured as a midsole and/or outsole of the sole system 110. In the example shown in FIGS. 1-10, the sole member 122 comprises a monolithic or unitary structure that provides support and strength, as well as a durable outer ground engaging surface for the sole system 110.

Optionally, in other examples, the sole member 122 can comprise a separate midsole and outsole.

Figure 10:
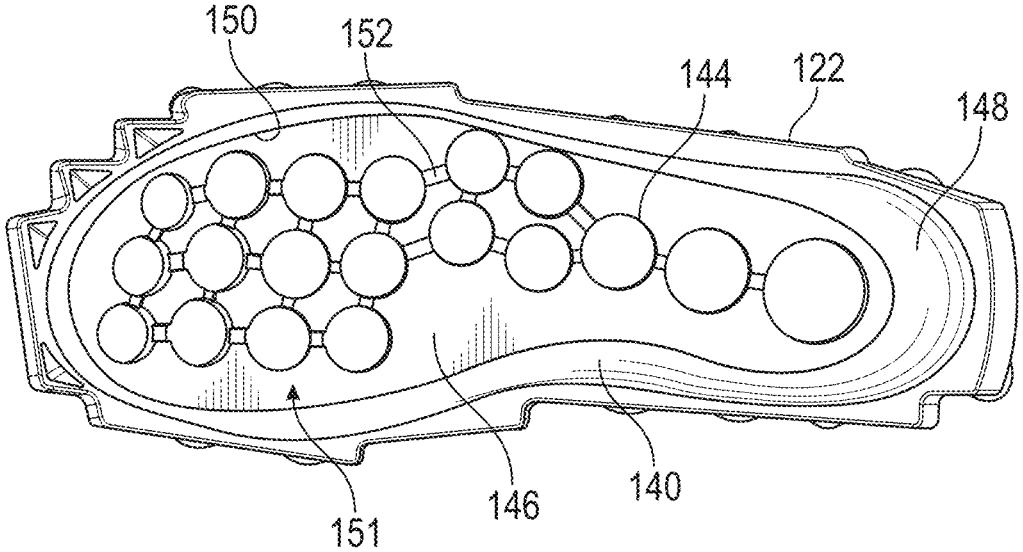
FIG. 10 is a top view of the sole member of the sole system of FIG. 9.

The sole member 122 is shown alone (top or interior view) in FIG. 10 and shown unassembled from a remainder of the sole system 110 in FIG. 9. The sole member 122 is shown assembled with the remainder of the sole system 110 and the upper 102, to form the article 100, in FIGS. 1-7.

The sole member 122 can have an outwardly facing surface 138 (or a ground-facing surface, as shown in FIG. 3) and an inwardly facing surface 140 (as shown in FIGS. 9 and 10) that is disposed opposite of the outwardly facing surface 138. The outwardly facing surface 138 can be a ground facing, or ground engaging, surface, as shown in FIGS. 7-8B which depict the outwardly facing surface contacting a ground surface 160 (as described further below).

The inwardly facing surface 140 can be disposed closer to a foot than the outwardly facing surface 138. The inwardly facing surface 140, in some examples, faces and contacts the inner member 130.

It will be understood that the outwardly facing surface 138 and the inwardly facing surface 140 can also be referred to as an outer surface and an inner surface, respectively.

The sole member 122 includes a sidewall or sidewall surface 142 that extends between the outwardly facing surface 138 and the inwardly facing surface 140, which is oriented approximately in the vertical direction (as shown in FIG. 9).

As introduced above, the sole member 122 includes apertures 144 that are spaced apart in a longitudinal and/or lateral direction along the sole member 122. Each aperture 144 extends through an entire thickness of the sole member 122, from the inwardly facing surface 140 to the outwardly facing surface 138.

The inwardly facing surface 140 can comprise a depressed region 146 and a raised region 148, where the depressed region 146 is depressed into the sole member 122 from the raised region 148 toward the outwardly facing surface 138 (as shown in FIGS. 9 and 10).

The apertures 144 can be disposed within the depressed region 146. The depressed region 146 can be configured to receive the protruding member assembly 124.

In some examples, the depressed region 146 can be shaped to receive the inner member 130. For example, a vertically extending edge 150 can extend between the raised region 148 and the depressed region 146 of the inwardly facing surface 140 (as shown in FIGS. 9 and 10). A height of the edge 150 can be defined such that it corresponds to a thickness (or height, in the vertical direction) of the inner member 130. As such, the inner member 130 can fit within a depression 151 defined by the depressed region 146 and the edge 150 (as shown in FIG. 7).

More specifically, the inner member 130 can fit within the depression 151 with its first surface 134 arranged against (in face-to-face contact with) the depressed region 146 of the inwardly facing surface 140 (and covering the connecting portions 128 of the protruding member assembly 124, as described further below).

In this assembled configuration, the apertures 132 in the inner member 130 are aligned with the corresponding apertures 144 in the sole member 122 (as shown in FIG. 7).

In some examples, such as for the sole member 122 shown in FIGS. 9 and 10, the depressed region 146 can extend along a majority of a length of the sole member 122 (e.g., along a portion of the forefoot portion 112, all of the midfoot portion 114, and a portion of the heel portion 116 of the sole system 110), and all of the apertures 144 can be disposed within the depressed region 146.

In alternative examples, the depressed region 146 can extend along a smaller portion of the sole member, such as along a portion of the forefoot portion and the midfoot portion (similar to the example shown in FIGS. 13-16, as described below), along only the forefoot portion, or along only the heel portion.

In order for the protruding member assembly 124 to be assembled with the sole member 122, the plurality of apertures 144 are arranged in a configuration on the sole member 122 that corresponds to the arrangement of plurality of protruding members 126 of the protruding member assembly 124. Further, a shape and size (e.g., diameter, width, or the like) of each aperture 144 can correspond to a shape and size of the corresponding protruding member 126 it is configured to receive. For example, the shape of each aperture 144 can be slightly larger than a shape (e.g., diameter, width, or the like) of the corresponding protruding member 126 it is configured to receive. For example, as shown in FIGS. 3 and 7, a diameter of each aperture 144 (and each aperture 132) can be slightly larger than the diameter of the corresponding protruding member 126, thereby providing some clearance for the protruding member 126 to move vertically within the aperture 144 (and aperture 132). The plurality of apertures 144 are in one-to-one correspondence with the plurality of protruding members 126 so that each protruding member 126 is received in a corresponding aperture 144.

Thus, the pattern or arrangement of the plurality of apertures 144, and the shape (e.g., diameter) of each aperture 144, within the sole member 122 is seen to match and/or correspond to the pattern or arrangement and shape(s) of the plurality of protruding members 126 within protruding member assembly 124 (as shown in FIGS. 3 and 9-11).

In some examples, the inwardly facing surface 140 (e.g., the depressed region 146 of the inwardly facing surface 140) includes channels or recesses 152 (as shown in FIGS. 9 and 10) that are shaped, sized, and oriented to receive the connecting portions 128 of the protruding member assembly 124. For example, each recess 152 is configured to receive a corresponding one of the connecting portions 128.

As seen in FIG. 10, the recesses 152 extend between adjacent apertures 144, with the apertures 144 and recesses 152 forming a pattern on the inwardly facing surface 140 that matches the pattern of the corresponding protruding members 126 and connecting portions 128 of the protruding member assembly 124. In some examples, a depth (in the vertical direction) of the recesses 152 may be specified so that the connecting portions 128 are flush with, or recessed within, the depression region 146 of the inwardly facing surface 140.

In other examples, the recesses 152 may be shallower so that some portions of the connecting portions 128 are raised above the depressed region 146 of the inwardly facing surface 140.

In some examples, as shown in FIG. 9, the recesses 152 do not extend through an entire thickness of the sole member 122 (e.g., the recesses 152 do not extend to the outwardly facing surface 138).

The outwardly facing surface 138 of the sole member 122 can comprise a base surface 156 and a plurality of protruding members 158 protruding outward and away from the base surface 156 (as shown in FIGS. 3-5 and 7). The protruding members 158 can be configured as lugs, cleats, or another traction element that are configured to engage the ground surface (e.g., ground surface 160 shown in FIGS. 7-8B). The protruding members 158 can have various sizes and shapes and be arranged across the base surface 156 in locations that do not include apertures 144. For example, each protruding member 158 can be offset (laterally and/or longitudinally) from adjacent apertures 144.

The protruding members 158 can have various shapes, such as being spherical, conical, domed, cylindrical, spiked, and the like. In some examples, the sole member 122 can have protruding members 158 having a variety of shapes and sizes, such as conical protruding members, and spherical or domed-tipped protruding members. In some examples, the sole member 122 can have protruding members 158 of varying size, such as protruding members 158 with different diameters, width, heights (in the vertical direction), or the like.

In some examples, the sole member 122 can have protruding members 158 having a same shape but various sizes, the same shape and size, or various shapes and sizes.

In some examples, as shown in FIG. 3, the protruding members 158 can be arranged on a peripheral portion (or periphery) of the base surface 156 with the protruding members 126 of the protruding member assembly 124 extending out of and past the base surface 156 on a more central portion of the base surface 156. In this way, in some instances, the protruding members 158 can be arranged outside of the protruding members 126 relative to a center of the sole system 110 and article of footwear 100. In some examples, the center of the sole system 110 can be about halfway between a toe 113 and heel 115 of the sole system 110, along a central longitudinal axis 162 of the sole system 110 (as depicted in FIG. 3).

Unlike the movable protruding members 126 of the protruding member assembly 124, the protruding members 158 of the sole member 122 are stationary relative to the base surface 156 of the sole member 122. Said another way, the protruding members 158 are fixed to the base surface 156 (and cannot move further inward, past the base surface 156).

In some examples, the protruding members 126 of the protruding member assembly 124 can extend beyond or past (in the vertical direction) the protruding members 158 in an undepressed state of the sole system 110 (e.g., when not engaging or pressed into the ground surface 160, as shown in FIG. 7 and described in more detail below).

In some examples, the protruding members 126 of the protruding member assembly 124 can be oriented flush with one or more protruding members 158 and/or the base surface 156 of the sole member 122 when the sole system 110 is in a depressed state (e.g., when engaging and pressing against the ground surface 160, as shown in FIGS. 8A and 8B). In this way, the protruding members 158 of the sole member 122 can be configured as stopping or support points for the movable protruding members 126.

In some examples, the sole member 122 can include one or more additional elements, such as siping 166 (as shown in FIGS. 1-3). The siping 166 can be thin grooves or slits that extend into the sole member 122 from the base surface 156. In some examples, the siping 166 can be referred to as a network of interconnected slits or grooves.

In some examples, the siping 166 can be laser cut into a material (e.g., foam) of the sole member 122.

In some examples, a depth of the siping 166 (or an amount the siping extends into the sole member 122 from the base surface 156) can be in a range of 1.5 to 3.5 mm. The siping 166 can be configured to increase a flexibility of the sole member 122 (and thus the sole system 110).

In some examples, the siping 166 can include medial-to-lateral (or lateral) siping 166 that extends in a direction extending between the lateral side 118 and the medial side 120 of the sole system 110 and toe-to-heel (or longitudinal) siping 166 that extends in a direction extending between the toe 113 and the heel 115 of the sole system 110. In some examples, the medial-to-lateral siping 166 and the toe-to-heel siping 166 can be interconnected (or intersect). For example, in some instances, the siping 166 can form a grid around the protruding members 126 of the protruding member assembly 124.

In some examples, as shown in FIG. 3, the siping 166 can extend between adjacent rows of protruding members 126 and in between adjacent protruding members 126 within the same row (where the rows extend approximately between the lateral side 118 and medial side 120 of the sole system 110). As a result, the entire bottom (or ground facing portion) of the sole system 110 can move with the wearer's foot. This can increase the sensation that the sole system 110 is part of the wearer's foot.

In some examples, the siping 166 can extend between adjacent protruding members 158.

In some examples, the siping is formed by laser etching into the sole member 122.

To assemble the protruding member assembly 124 with the sole member 122, the protruding member assembly 124 can be inserted into the inwardly facing surface 140 of the sole member 122 (into the depressed region 146) such that the protruding members 126 are inserted and extend through the corresponding apertures 144 in the sole member 122. As a result, a portion of the protruding members 126, such as the second end portions 125 and a portion of the intermediate portions 127, can extend out of (outwardly from) the outwardly facing surface 138 of the sole member 122 (as shown in FIGS. 1-5 and 7-8B). In some examples, the protruding members 126 can be spaced away from the apertures 144 through which they extend such that they "float" and can move within the corresponding apertures 144 as the sole system 110 interacts with a ground surface.

The connecting portions 128 can be received within the corresponding recesses 152 of the inwardly facing surface 140. With this arrangement, the connecting portions 128 can form a supporting structure along the inwardly facing surface 140 from which the protruding members 126 are suspended. This arrangement facilitates the articulation of individual protruding members 126, as discussed in further detail below.

The sole system 110 can be further assembled by inserting the inner member 130 into the sole member 122, against the depressed region 146 of the inwardly facing surface 140. For example, the inner member 130 can be positioned against the inwardly facing surface 140 such that the first end portions 123 (in in some cases a more proximal end of the intermediate portions 127) of the protruding members 126 are received within the corresponding apertures 132 of the inner member 130 (as shown in FIG. 7). The inner member 130 can be positioned over the connecting portions 128 of the protruding member assembly 124. As such, at least a portion of the protruding member assembly 124 (e.g., the connecting portions 128) can be sandwiched between the inner member 130 and the sole member 122.

In some examples, the first end portion 123 of each protruding member 126 can be flush with, or extend outwardly from, the second surface 136 of the inner member 130 (in the undepressed state). As shown in FIG. 7, in some examples, the first end portion 123 of each protruding member 126 is approximately flush with the second surface 136 of the inner member 130.

However, in other examples, at least some protruding members may extend outwardly from or beyond the second surface 136 of the inner member 130 (in the undepressed state). In other words, in some examples, first end portions 123 of some protruding members 126 could be raised with respect to the second surface 136 of the inner member 130. It is also contemplated that in some examples, the first end portions 123 of some protruding members 126 could be recessed with respect to the second surface 136 of the inner member 130. As discussed in further detail below, the relative distance of each first end portion 123 of the protruding members 126 from the second surface 136 of the inner member 130 can vary as the sole system 110 comes into contact with a ground surface 160.

When the sole system is assembled, as described above and shown in FIGS. 1-8B, the protruding members 126 extend outwardly from the base surface 156 of the sole member 122 by a distance 155 (as shown in FIG. 7). The distance 155 can be measured from the second end portions 125 of the protruding member 126 to the base surface 156. In some examples, the distance 155 is in a range of 2-6 mm, 3-5 mm, 3.5-4.5 mm, or about 4 mm.

In some examples, the distance 155 can be the same for each protruding member 126. In other examples, however, two or more different protruding members 126 can extend different distances 155 from the base surface 156. Further, as discussed in more detail below, the extent to which each protruding member 126 extends from a corresponding aperture 144 and the surrounding base surface 156 can vary as the sole system 110 comes into contact with a ground surface (e.g., ground surface 160 shown in FIGS. 7-8B).

In some examples, the protruding members 158 of the sole member 122 can extend outwardly from the base surface 156 of the sole member 122 by a distance 157 (as shown in FIG. 7). In some examples, the distance 157 is smaller than the distance 155 in the undepressed state of the sole system 110. In some examples, a difference between the distance 155 and the distance 157 is in a range of 3.5 to 4.5 mm, 3.8 to 4.1 mm, or 3.9 to 4.05 mm.

In some examples, the distance 157 can be the same for each protruding member 158. In other examples, however, two or more different protruding members 158 can extend different distances 157 from the base surface 156.

FIGS. 7-8B show cross-sectional side views of the article 100 including the sole system 110 which is being worn by a user, as shown by a wearer's foot 164 disposed within the article 100. FIG. 7 shows the sole system 110 and protruding member assembly 124 in an undepressed state, prior to the wearer engaging and pressing into the ground surface 160. FIGS. 8A and 8B show the sole system 110 and protruding member assembly 124 in various depressed states where a wearer is walking or running (or otherwise moving) and engaging the ground surface 165 with different portions of the sole system 110 (such as the forefoot portion 112 in FIG. 8A and the heel portion 116 in FIG. 8B).

Turning to FIG. 8B, as the wearer pushes onto their forefoot, the forefoot portion 112 of the sole system 110 engages and pushes against the ground surface 160. As a result, the movable protruding members 126 in the forefoot portion 112 are pressed upward, toward and into (or against) the wearer's foot 164. More specifically, as the second end portion 125 of each protruding member 126 in the forefoot portion 112 engages the ground surface 160, the corresponding protruding member 126 moves through the corresponding aperture 144 in the sole member 122 (and through the corresponding aperture 132 in the inner member 130) such that the first end portion 123 of the protruding member 126 extends past the inner member 130 and into or against the wearer's foot 164. As such, the wearer's foot experiences a tactile response and/or stimulation in the corresponding region of their foot 164. For example, an upward pressure can be felt against the wearer's foot 164 at each protruding member 126 in the forefoot portion 112 that is engaging the ground surface 160.

In some examples, the amount of upward pressure or stimulation that the wearer's foot 164 experiences at each stimulation point or protruding member 126 can be based on a force with which the wearer's foot 164 pushes into the ground surface 160 and/or how much or each protruding member 126 is pressed into the ground surface (for example, if the wearer hits the ground at an angle). In this way, based on a wearer's type of activity (e.g., running vs. walking vs. jumping), natural stride foot movement (e.g., pronation vs. supination), type of ground surface on which they are move (e.g., gravel, pavement, grass, sand, and the like), and the like, the pressures applied to the foot 164 by the activated protruding members 126 (the protruding members 126 engaging the ground surface 160) can vary. As such, a wearer can experience different amounts of stimulation at various regions or portions of their foot as they move and participate in different activities, or move over various terrains, while they are wearing the article.

As shown in FIG. 8A (and FIG. 8B), the protruding members 158 of the sole member 122 are stationary relative to the base surface 156 and do not move upward or depress into the wearer's foot 164 or the inner member 130, even when engaging the ground surface 160. Instead, the protruding members 158 can engage the ground surface 160 and act as a stop for the movement of the protruding members 126 (e.g., the second end portions 125 of the protruding members 126 may not move further into the sole system 110, past the protruding members 158). Thus, in some instances, the protruding members 126 can be referred to as active protruding members of the sole system 110, while the protruding members 158 of the sole member 122 can be referred to as non-active protruding members of the sole system 110.

It should be noted that although the protruding members 158 may depress or deform slightly against the ground surface 160, this slight movement does not include vertical movement into and relative to the remainder of the sole system 110 (such as the base surface 156, inner member 130, and/or upper 102). In contrast, the protruding members 126 move vertically into the sole system 110 and apply a force (e.g., pressure) against the wearer's foot, in response to a vertically upward force applied to the protruding member 126 by the ground surface 160.

It should also be noted that the amount of movement of the protruding members 126 into the wearer's foot 164 shown in both FIGS. 8A and 8B may be exaggerated for the purpose of illustration, and in reality, may be less than shown.

Turning now to FIG. 8B, as the wearer hits the ground surface 160 with their heel, the heel portion 116 of the sole system 110 engages and pushes against the ground surface 160. As a result, the movable protruding members 126 in the heel portion 116 are pressed upward, toward and into (or against) the wearer's foot 164. More specifically, as the second end portion 125 of each protruding member 126 in the heel portion 116 engages the ground surface 160, the corresponding protruding member 126 moves through the corresponding aperture 144 in the sole member 122 (and through the corresponding aperture 132 in the inner member 130) such that the first end portion 123 of the protruding member 126 extends past the inner member 130 and against the wearer's foot 164. As such, the wearer's foot experiences a tactile response and/or stimulation in the corresponding region of their foot 164. For example, an upward pressure can be felt against the wearer's foot 164 at each protruding member 126 in the heel portion 116 that is engaging the ground surface 160.

In some examples, the sole system 110 can have a protruding member assembly with a different number, arrangement, size, and/or shape of protruding members. As a result, the corresponding inner member and sole member can be shaped differently as well such that they correspond to the different protruding member assembly.

Figure 14:
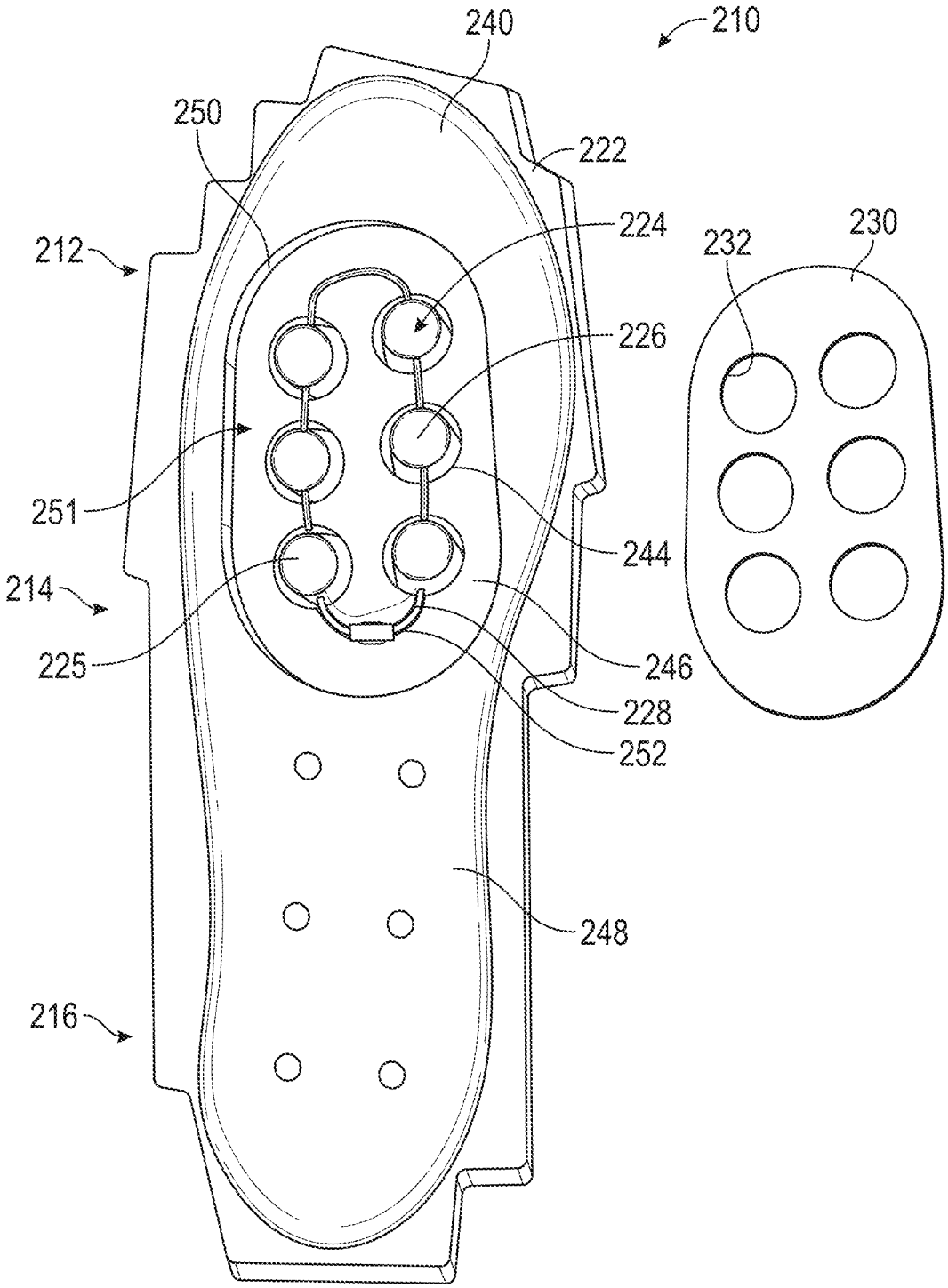
FIG. 14 is a top view of the sole system of FIG. 13 with the protruding member assembly assembled with the sole member and the inner member removed.
Figure 15:
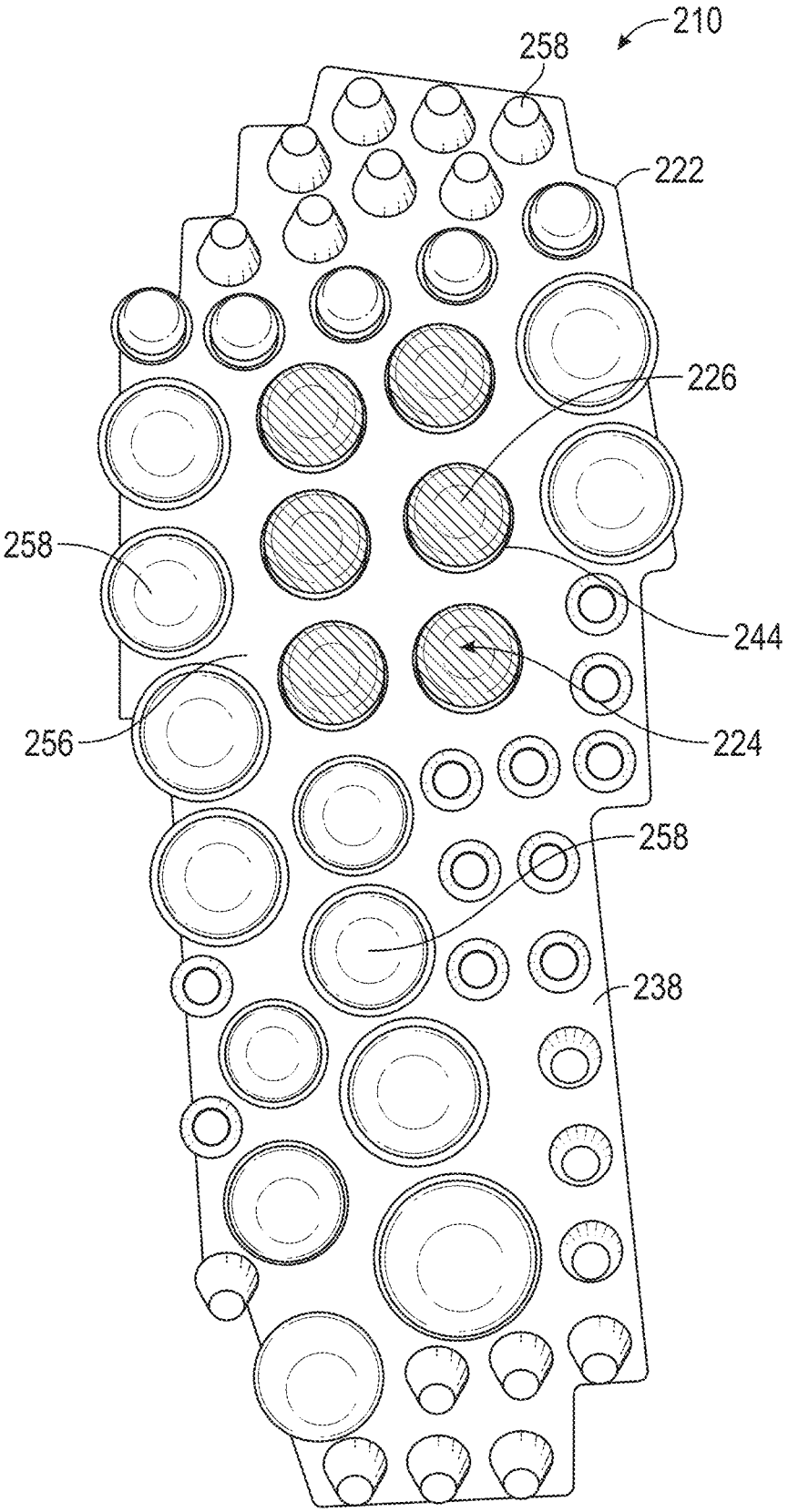
FIG. 15 is a bottom view of the assembled sole system of FIG. 13.
Figure 16:
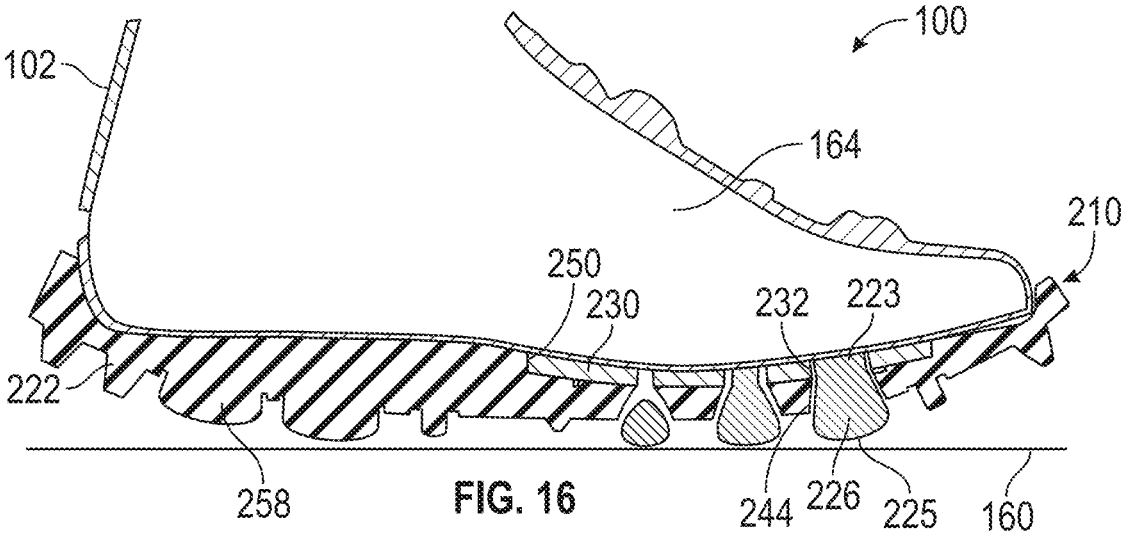
FIG. 16 is a cross-sectional side view of the sole system of FIG. 13 included in an article of footwear.

As an example, FIGS. 13-16 show a sole system 210 that comprises a protruding member assembly 224 and sole member 222. In some examples, as shown in FIGS. 13, 14, and 16, the sole system 210 can also include an inner member 230. FIG. 13 shows an exploded view of the sole system 210, FIG. 14 shows a top view of the protruding member assembly 224 assembled with the sole member 222 with the inner member 230 removed, FIG. 15 shows a bottom view of the assembled sole system 210, and FIG. 16 shows a cross-sectional side view of the article of footwear 100 which comprises the sole system 210.

In some examples, the sole system 210 can be used in lieu of the sole system 110 in the article of footwear 100 (as shown in FIG. 16). The components of the sole system 210 can be similar to the components of the sole system 110, and thus corresponding components are numbered similarly. For example, the sole member 222 can have a similar overall structure to that of the sole member 122, except it can have a smaller depressed region 246 with fewer apertures 244 which are configured to receive a corresponding number of movable protruding members 226 of the protruding member assembly 224.

More specifically, the sole member 222 can have a similar overall structure to that of sole member 122, including an outwardly facing surface 238 (as shown in FIG. 15), an inwardly facing surface 240 (as shown in FIGS. 13 and 14), and a sidewall surface 242 extending therebetween (as shown in FIG. 13).

In some examples, the inwardly facing surface 240 includes the depressed region 246 with the apertures 244 extending therethrough, and a raised region 248. The depressed region 246 can be shaped to receive the inner member 230. For example, a vertically extending edge 250 can extend between the raised region 248 and the depressed region 246 of the inwardly facing surface 240 (as shown in FIGS. 13 and 14). The inner member 230 can fit within a depression 251 defined by the depressed region 246 and the edge 250 (as shown in FIG. 16).

When assembled together, the apertures 232 in the inner member 230 are aligned with the corresponding apertures 244 in the sole member 222 (as shown in FIG. 16).

In contrast to the sole member 122, the depressed region 246 can extend along only a portion of a length of the sole member 222. For example, as shown in FIGS. 13, 14, and 16, the depressed region 246, as well as the protruding member assembly 224 and inner member 230 that are disposed therein when the sole system 210 is assembled, extend along only portion of the forefoot portion 212 and the midfoot portion 214 of the sole system 210 (and not into the heel portion 216)

Similar to the sole member 122, the outwardly facing surface 238 of the sole member 222 can comprise a base surface 256 and a plurality of protruding members 258 protruding outward and away from the base surface 256 (as shown in FIGS. 15-16). The protruding members 258 can be configured the same or similar to the protruding members 158, as described above. For example, the protruding members 258 can be configured as lugs, cleats, or another traction element that is configured to engage the ground surface (e.g., ground surface 160 shown in FIG. 16). The protruding members 258 can have various sizes, shapes, and arrangements across the sole member 222, and can be arranged across the base surface 256 in locations that do not include apertures 244.

For example, as shown in FIG. 15, the sole member 222 may have a larger number of protruding members 258 than the sole member 122 since the protruding member assembly 224 includes fewer protruding members 226 than the protruding member assembly 124 (e.g., six protruding members 126 shown in FIGS. 13-15 vs. 19 protruding members 126 shown in FIGS. 3, 9, and 11).

The arrangement of the protruding member assembly 224 and the sole member 222 can be configured to provide stimulation during use to primarily the forefoot and the midfoot (or portions thereof) of the wearer's foot, via the arrangement of the protruding members 226. In some examples, the protruding member assembly 224 can have more or less than the six protruding members 226 shown in FIGS. 13-15, such as four, seven, nine, or the like.

In some examples, smaller the protruding member assembly 224 can include a greater number (e.g., nine) of smaller (e.g., smaller diameter) protruding members 226 in the depressed region 246 of the sole member 222.

In some examples, the protruding member assembly 224 can include a smaller number (e.g., four) of larger (e.g., larger diameter) protruding members 226 in the depressed region 246 of the sole member 222.

Similar to the protruding members 126, the protruding members 226 can have a first end portion 223 (or proximal portion), a second end portion 225 (or distal portion), and an intermediate portion 227 that is disposed between the first end portion 223 and the second end portion 225, as indicated in FIG. 13. The second end portion 225 of each protruding member 226 can be configured to contact a ground surface (e.g., ground surface 160 in FIG. 16). The first end portion 223 of each protruding member 226 can be in direct contact with a wearer's foot, or in indirect contact with the wearer's foot (e.g., via a bottom portion of the upper 102, a sock liner, or an insole), thereby allowing the foot to interact with the protruding members 226 in a similar manner to the protruding members 126, as discussed above. For example, the first end portion 223 of each protruding member 226 can be configured to interact with (e.g., apply pressure to and stimulate) the wearer's foot.

Instead of individual connecting portions 128, the protruding member assembly 224 can comprise a connecting member 228, which is configured as a cable, wire, tether, textile loop, or the like, that interconnects all the protruding members 226. In some examples, as shown in FIG. 14, the connecting member 228 (or connecting cable or wire) can extend through a portion of each protruding member 226 of the protruding member assembly 224 (e.g., through the intermediate portion 227 of each protruding member 226). For example, the protruding members 226 can have channels extending therethrough which are configured to receive the connecting member 228.

In some examples, the connecting member 228 can be referred to as connecting portions that interconnect the protruding members 226, where each section of the connecting member 228 that extends between two adjacent protruding members 266 can be a connecting portion.

In some examples, the connecting member 228 forms a closed loop (as shown in FIG. 14).

In alternative examples, the protruding members 226 can be connected together by connecting portions the same as or similar to the connecting portions 128.

In some examples, the connecting member 228 is configured to be arranged within a complementary-shaped depression, channel, or recess 252 in the depressed region 246 of the sole member 222, when the protruding member assembly 224 is assembled in the sole member 222.

In some examples, the connecting member 228 is deformable or flexible to allow for individual vertical movement (e.g., up and down) of the protruding members 226 through the apertures 244. For example, the connecting member 228 can allow a first protruding member 226 to move vertically relative to one or more other protruding members 226, while maintaining all of the protruding members 226 arranged inside the sole system 210 (e.g., without them freely falling out).

The operation of the sole system 210 can be the same or similar to the operation of the sole system 110 in the article 100 (or another article having a different style, shape, structure, or the like), as described above.

Figure 17:
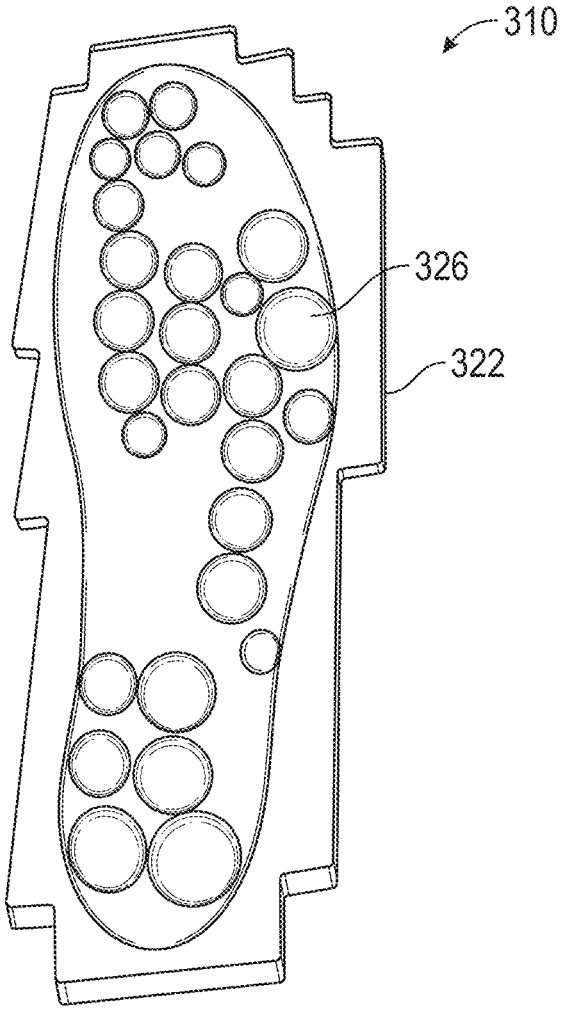
FIG. 17 is a top view of a portion of another exemplary sole system for an article of footwear.

FIG. 17 shows yet another exemplary arrangement of movable protruding members 326 of a protruding member assembly of a sole system 310. The sole system 310 can include similar components to those of sole system 110 and/or sole system 210, as described above. FIG. 17 presents a simplified top view of a portion of the sole system 310, showing an exemplary arrangement of protruding members 326 within a sole member 322. Even though not depicted (for the sake of simplicity alone) in FIG. 17, the protruding members 326 can be interconnected via connecting portions (the same or similar to connecting portions 128) or a connecting member (the same or similar to the connecting member 228).

In the example shown in FIG. 17, the sole system 310 comprises 28 movable protruding members 326. In contrast to the sole system 110, the sole system 310 has a greater number of protruding members 326 in the heel portion and a different arrangement of protruding members 326 in the forefoot portion.

The sole member 322 can, in some instances, include a plurality of fixed or non-active (or non-vertically movable relative to a remainder of the sole system 110) protruding members disposed in regions of the sole member 322 that do no have protruding members 326 passing therethrough.

In this way, the number, shape, size, and arrangement of active or vertically movable protruding members of a sole system can be specified based on desired stimulation or activation points for a wearer's foot. In some instances, the location and/or number of desired foot stimulation or activation points can be changed based on the intended wearer of the article of footwear (e.g., male, female, weight, height, or the like), the intended activity for the article (e.g., soccer, hiking, walking, tennis, or the like), and/or the intended ground surface during use of the article (e.g., gravel, pavement, turf, sand, court, or the like). Further, in some examples, an arrangement of the active protruding members across the sole system can be specified based on a target benefit for the wearer, such as increased circulation, decreased blood pressure, or the like.

By interconnecting the protruding members of the protruding member assembly with connecting portions and supporting and sandwiching the connecting portions between the sole member and the inner member, the protruding members can move relative to one another and relative to the sole system and inner member, without falling out or becoming dislodged from the article of footwear.

Further, by providing the sole member with stationary or non-active protruding members, the protruding members of the protruding member assembly can be supported and provide a specified amount of pressure (or stimulation) to the foot of the wearer (without pushing too hard against the wearer's foot).

Additionally, in some instances the sole member can comprise slits or siping arranged between adjacent protruding members of the protruding member assembly. This can increase a flexibility of the sole member and provide a sensation to the wearer that an entire bottom of the sole system is moving with them (or is part of their foot).

ADDITIONAL EXAMPLES OF THE DISCLOSED TECHNOLOGY

Additional examples of the disclosed technology are enumerated below.

Example 1. We claim a sole system for an article of footwear, comprising: a sole member comprising an outwardly facing surface, an inwardly facing surface, and a plurality of spaced apart first apertures extending though the sole member, between the inwardly facing surface and the outwardly facing surface, wherein the sole member comprises a plurality of first protruding members extending outward from a base surface of the outwardly facing surface, and wherein each first protruding member is fixed to the base surface; and a protruding member assembly comprising a plurality of second protruding members that are interconnected by connecting portions, wherein the connecting portions are received on the inwardly facing surface of the sole member, and wherein each second protruding member is vertically movable within a corresponding first aperture of the plurality of spaced apart first apertures of the sole member.

Example 2. The sole system of any example herein, particularly example 1, wherein each second protruding member is movable between an undepressed state when it is not engaging a ground surface and a depressed state when it is engaging and pressed against the ground surface, and wherein in the undepressed state of the second protruding member, the second protruding member extends farther outward from the base surface than one or more adjacent first protruding members.

Example 3. The sole system of any example herein, particularly example 2, wherein in the depressed state of the second protruding member, at least a portion of the second protruding member is depressed inward into the sole system relative to the base surface of the sole member, with its distal end arranged flush with one or more adjacent first protruding members, relative to the ground surface.

Example 4. The sole system of any example herein, particularly any one of examples 1-3, further comprising an inner member comprising a plurality of spaced apart second apertures, each second aperture configured to receive a portion of a corresponding second protruding member, and wherein the inner member is disposed against the inwardly facing surface of the sole member such that the connecting portions are sandwiched between the inner member and the inwardly facing surface of the sole member.

Example 5. The sole system of any example herein, particularly any one of examples 1-4, wherein the plurality of second protruding members is arranged across a central portion of sole system that is spaced away from a periphery of the sole member, and wherein the plurality of first protruding members is arranged outside of the plurality of second protruding members relative to a center of the sole system.

Example 6. The sole system of any example herein, particularly example 5, wherein the plurality of second protruding members is arranged along a majority of a length of the sole member, wherein the length is measured between a toe and heel of the sole member.

Example 7. The sole system of any example herein, particularly example 6, wherein one or more second protruding members of the plurality of second protruding members that are disposed in heel portion of the sole system have a larger diameter than one or more second protruding members of the plurality of second protruding members that are disposed in a forefoot portion of the sole system.

Example 8. The sole system of any example herein, particularly any one of examples 1-7, wherein each second protruding member has a first end portion, a second end portion, and an intermediate portion disposed between the first and second end portions, and wherein each connecting portion is connected to the intermediate portion of each of two adjacent second protruding members.

Example 9. The sole system of any example herein, particularly example 8, wherein the first end portion is flat and configured to contact a foot of wearer of the article of footwear, and wherein the second end portion is rounded and configured to contact a ground surface.

Example 10. A sole system for an article of footwear, comprising: a sole member comprising an outwardly facing surface configured to interface with a ground surface, an inwardly facing surface, and a plurality of spaced apart first apertures extending though the sole member, between the inwardly facing surface and the outwardly facing surface; an inner member comprising a plurality of spaced apart second apertures extending through the inner member, wherein the inner member is disposed against the inwardly facing surface of the sole member such that each second aperture is aligned with a corresponding first aperture of the sole member; and a protruding member assembly comprising a plurality of protruding members that are interconnected by a plurality of connecting portions, wherein each connecting portion is sandwiched between the inwardly facing surface of the sole member and the inner member, and wherein each protruding member is vertically movable within a corresponding first aperture and second aperture.

Example 11. The sole system of any example herein, particularly example 10, wherein each protruding member is movable between an undepressed state when it is not engaging a ground surface and a depressed state when it is engaging and pressed against the ground surface, wherein each protruding member has a first end portion, a second end portion, and an intermediate portion disposed therebetween, and wherein in the depressed state of the second protruding member, the first end portion of the second protruding member is arranged farther away from the inner member than in the undepressed state and the second end portion of the second protruding member is arranged closer to the corresponding first aperture than in the undepressed state.

Example 12. The sole system of any example herein, particularly example 11, wherein the sole member comprises a plurality of fixed protruding members that extend outwardly from and are fixed to a peripheral portion of a base surface of the outwardly facing surface, and wherein the plurality of protruding members of the protruding member assembly are disposed across a central portion of the base surface.

Example 13. The sole system of any example herein, particularly example 12, wherein in the undepressed state of each protruding member of the protruding member assembly, the protruding member extends farther outward from the base surface than one or more adjacent fixed protruding members of the sole member.

Example 14. The sole system of any example herein, particularly any one of examples 10-13, wherein the inwardly facing surface of the sole member comprises a plurality of recesses extending between adjacent first apertures, and wherein each recess of the plurality of recesses is configured to receive a corresponding connecting portion of the plurality of connecting portions.

Example 15. The sole system of any example herein, particularly any one of examples 10-14, wherein the outwardly facing surface of the sole member comprises a plurality of slits extending into the sole member, toward the inwardly facing surface, and wherein the plurality of slits includes medial-to-lateral extending slits and toe-to-heel extending slits that form a grid around the plurality of protruding members of the protruding member assembly.

Example 16. An article of footwear comprising: a sole system comprising: a sole member comprising an outwardly facing surface, an inwardly facing surface, and a plurality of spaced apart first apertures extending though the sole member, between the inwardly facing surface and the outwardly facing surface, wherein the outwardly facing surface comprises a base surface and a network of interconnected slits that extend into the sole member from the base surface, toward the inwardly facing surface; and a protruding member assembly comprising a plurality of first protruding members that are interconnected by a plurality of connecting portions, wherein each connecting portion is received on the inwardly facing surface of the sole member, wherein each first protruding member is vertically movable within a corresponding first aperture of the plurality of spaced apart first apertures of the sole member, and wherein the network of interconnected slits are formed around and between adjacent first protruding members of the plurality of first protruding members.

Example 17. The article of footwear of any example herein, particularly example 16, further comprising an upper secured to the sole system, and wherein the plurality of first protruding members is spaced away from a periphery of the sole member where the sole member connects to the upper.

Example 18. The article of footwear of any example herein, particularly either example 16 or example 17, wherein the outwardly facing surface comprises a plurality of second protruding members fixed to and extending outward from the base surface, and wherein the plurality of second protruding members is arranged outside of the plurality of first protruding members relative to a central longitudinal axis of the sole system.

Example 19. The article of footwear of any example herein, particularly any one of examples 16-18, wherein the sole system further comprises an inner member comprising a plurality of spaced apart second apertures extending through the inner member, between opposing first and second surfaces of the inner member, and wherein the first surface of the inner member is disposed against the inwardly facing surface of the sole member such that each second aperture is aligned with a corresponding first aperture of the sole member.

Example 20. The article of footwear of any example herein, particularly example 19, wherein each connecting portion is arranged between the inwardly facing surface of the sole member and the first surface of the inner member, and wherein each protruding member is vertically movable within a corresponding first aperture and second aperture.

In view of the many possible examples to which the principles of the disclosed technology may be applied, it should be recognized that the illustrated examples are only preferred examples of the disclosed technology and should not be taken as limiting the scope of the claimed subject matter. Rather, the scope of the claimed subject matter is defined by the following claims and their equivalents.

The invention claimed is:

1. A sole system for an article of footwear, comprising:

a sole member comprising an outwardly facing surface, an inwardly facing surface, and a plurality of spaced apart first apertures extending though the sole member, between the inwardly facing surface and the outwardly facing surface, wherein the sole member comprises a plurality of first protruding members extending outward from a base surface of the outwardly facing surface, and wherein each first protruding member is fixed to the base surface;

a protruding member assembly comprising a plurality of second protruding members that are interconnected by connecting portions, wherein the connecting portions are received on the inwardly facing surface of the sole member, wherein each second protruding member is vertically movable within a corresponding first aperture of the plurality of spaced apart first apertures of the sole member, and wherein each second protruding member has a first end portion, a second end portion, and an intermediate portion disposed between the first and second end portions; and an inner member comprising a plurality of spaced apart second apertures, each second aperture configured to receive the first end portion of a corresponding second protruding member, wherein the inner member comprises an outwardly facing surface disposed against the inwardly facing surface of the sole member such that the connecting portions are sandwiched between the inner member and the inwardly facing surface of the sole member, wherein each second protruding member is movable between an undepressed state when it is not engaging a ground surface and a depressed state when it is engaging and pressed against the ground surface, and wherein in the undepressed state, the first end portion of each second protruding member extends out of the inner member such that the first end portion is raised with respect to the inwardly facing surface of the inner member.

2. The sole system of claim 1, wherein in the undepressed state of the second protruding member, the second protruding member extends farther outward from the base surface than one or more adjacent first protruding members.

3. The sole system of claim 2, wherein in the depressed state of the second protruding member, at least a portion of the second protruding member is depressed inward into the sole system relative to the base surface of the sole member, with its distal end arranged flush with one or more adjacent first protruding members, relative to the ground surface.

4. The sole system of claim 1, wherein the inwardly facing surface of the sole member is recessed toward the outwardly facing surface of the sole member from a raised region formed around a perimeter of the sole member, thereby defining a depressed region in the sole member, and wherein the inner member is received within the depressed region.

5. The sole system of claim 1, wherein the plurality of second protruding members is arranged across a central portion of sole system that is spaced away from a periphery of the sole member, and wherein the plurality of first protruding members is arranged outside of the plurality of second protruding members relative to a center of the sole system.

6. The sole system of claim 5, wherein the plurality of second protruding members is arranged along a majority of a length of the sole member, wherein the length is measured between a toe and heel of the sole member.

7. The sole system of claim 6, wherein one or more second protruding members of the plurality of second protruding members that are disposed in heel portion of the sole system have a larger diameter than one or more second protruding members of the plurality of second protruding members that are disposed in a forefoot portion of the sole system.

8. The sole system of claim 1, wherein each connecting portion is connected to the intermediate portion of each of two adjacent second protruding members.

9. The sole system of claim 8, wherein the first end portion is flat and configured to contact a foot of wearer of the article of footwear, and wherein a ground-facing surface of the second end portion is spherical and configured to contact a ground surface.

10. A sole system for an article of footwear, comprising:

a sole member comprising an outwardly facing surface configured to interface with a ground surface, an inwardly facing surface, and a plurality of spaced apart first apertures extending though the sole member, between the inwardly facing surface and the outwardly facing surface, wherein the inwardly facing surface is recessed toward the outwardly facing surface from a raised region formed around a perimeter of the sole member, thereby defining a depression in the sole member;

an inner member comprising a plurality of spaced apart second apertures extending through the inner member, wherein the inner member is disposed against the inwardly facing surface of the sole member, within the depression, such that each second aperture is aligned with a corresponding first aperture of the sole member; and a protruding member assembly comprising a plurality of protruding members that are interconnected by a plurality of connecting portions, wherein each connecting portion is sandwiched between the inwardly facing surface of the sole member and the inner member, and wherein each protruding member is vertically movable within a corresponding first aperture and second aperture.

11. The sole system of claim 10, wherein each protruding member is movable between an undepressed state when it is not engaging a ground surface and a depressed state when it is engaging and pressed against the ground surface, wherein each protruding member has a first end portion, a second end portion, and an intermediate portion disposed therebetween, and wherein in the depressed state of the second protruding member, the first end portion of the second protruding member is arranged farther away from the inner member than in the undepressed state and the second end portion of the second protruding member is arranged closer to the corresponding first aperture than in the undepressed state.

12. The sole system of claim 11, wherein the sole member comprises a plurality of fixed protruding members that extend outwardly from and are fixed to a peripheral portion of a base surface of the outwardly facing surface, and wherein the plurality of protruding members of the protruding member assembly are disposed across a central portion of the base surface.

13. The sole system of claim 12, wherein in the undepressed state of each protruding member of the protruding member assembly, the protruding member extends farther outward from the base surface than one or more adjacent fixed protruding members of the sole member.

14. The sole system of claim 10, wherein the inwardly facing surface of the sole member comprises a plurality of recesses extending between adjacent first apertures, within the depression, and wherein each recess of the plurality of recesses is configured to receive a corresponding connecting portion of the plurality of connecting portions.

15. The sole system of claim 10, wherein the outwardly facing surface of the sole member comprises a plurality of slits extending into the sole member, toward the inwardly facing surface, and wherein the plurality of slits includes medial-to-lateral extending slits and toe-to-heel extending slits that form a grid around the plurality of protruding members of the protruding member assembly.

16. An article of footwear comprising:

a sole system comprising:

a sole member comprising an outwardly facing surface, an inwardly facing surface, and a plurality of spaced apart first apertures extending though the sole member, between the inwardly facing surface and the outwardly facing surface, wherein the outwardly facing surface comprises a base surface and a network of interconnected slits that extend into the sole member from the base surface, toward the inwardly facing surface; and a protruding member assembly comprising a plurality of first protruding members that are interconnected by a plurality of connecting portions, wherein each connecting portion is received on the inwardly facing surface of the sole member, wherein each first protruding member is vertically movable within a corresponding first aperture of the plurality of spaced apart first apertures of the sole member, and wherein the network of interconnected slits are formed around and between adjacent first protruding members of the plurality of first protruding members such that the interconnected slits extend between adjacent rows of first protruding members and in between adjacent first protruding members within the same row, and wherein the slits are thin slits that are thinner than half a diameter of the first protruding members.

17. The article of footwear of claim 16, further comprising an upper secured to the sole system, and wherein the plurality of first protruding members is spaced away from a periphery of the sole member where the sole member connects to the upper.

18. The article of footwear of claim 16, wherein the outwardly facing surface comprises a plurality of second protruding members fixed to and extending outward from the base surface, and wherein the plurality of second protruding members is arranged outside of the plurality of first protruding members relative to a central longitudinal axis of the sole system.

19. The article of footwear of claim 16, wherein the sole system further comprises an inner member comprising a plurality of spaced apart second apertures extending through the inner member, between opposing first and second surfaces of the inner member, and wherein the first surface of the inner member is disposed against the inwardly facing surface of the sole member such that each second aperture is aligned with a corresponding first aperture of the sole member.

20. The article of footwear of claim 19, wherein each connecting portion is arranged between the inwardly facing surface of the sole member and the first surface of the inner member, and wherein each protruding member is vertically movable within a corresponding first aperture and second aperture.

* * * * *